US007549687B2

(12) United States Patent
Takai

(10) Patent No.: US 7,549,687 B2
(45) Date of Patent: Jun. 23, 2009

(54) DISMOUNTING DEVICE FOR HEAVY LOAD HOISTING SLING

(75) Inventor: Seiichiro Takai, Tokyo (JP)

(73) Assignee: Totetu Mfg. Co., Ltd., Tokyo (JP)

( * ) Notice: Subject to any disclaimer, the term of this patent is extended or adjusted under 35 U.S.C. 154(b) by 304 days.

(21) Appl. No.: 10/519,230

(22) PCT Filed: Jun. 20, 2002

(86) PCT No.: PCT/JP02/06198

§ 371 (c)(1),
(2), (4) Date: Feb. 27, 2006

(87) PCT Pub. No.: WO04/000714

PCT Pub. Date: Dec. 31, 2003

(65) Prior Publication Data

US 2006/0202495 A1 Sep. 14, 2006

(51) Int. Cl.
*B66C 1/34* (2006.01)

(52) U.S. Cl. ..... 294/82.33; 294/82.32; 294/75

(58) Field of Classification Search ..... 294/74, 294/75, 82.21, 82.24, 82.31, 82.32, 82.33, 294/82.34

See application file for complete search history.

(56) References Cited

U.S. PATENT DOCUMENTS

| | | | | | |
|---|---|---|---|---|---|
| 408,620 | A | * | 8/1889 | Hitchcock | 294/82.33 |
| 845,693 | A | * | 2/1907 | Coats et al. | 294/82.33 |
| 922,929 | A | * | 5/1909 | Mallon | 294/75 |
| 1,233,376 | A | * | 7/1917 | Link | 294/82.33 |
| 2,131,445 | A | * | 9/1938 | Lawton | 294/82.33 |
| 2,858,161 | A | * | 10/1958 | Smith | 294/82.33 |
| 3,493,260 | A | * | 2/1970 | Smith | 294/82.33 |
| 3,926,467 | A | | 12/1975 | Crissy et al. | |
| 5,687,931 | A | * | 11/1997 | Hogan | 244/151 B |

FOREIGN PATENT DOCUMENTS

| | | |
|---|---|---|
| JP | 49-34551 | 9/1974 |
| JP | 54-1869 | 1/1979 |
| JP | 62-264191 A | 11/1987 |
| JP | 07-025578 | 1/1995 |
| JP | 7-206367 | 8/1995 |
| JP | 2000-153986 | 6/2000 |

* cited by examiner

*Primary Examiner*—Dean J Kramer
(74) *Attorney, Agent, or Firm*—Jules E. Goldberg; Buckley, Maschoff & Talwalkar LLC

(57) ABSTRACT

A base has at its upper end a crane engagement portion with which a hook of a crane is engaged. Pivotally engaged with a first shaft affixed to the base below the crane engagement portion, is a substantial center of a lever holder. Swingably mounted on a second shaft affixed to the base below the first shaft is a proximal end of a link lever, and this link lever has a distal end releasably engaged with a distal end of the lever holder. One end of a sling including the other end to be hung on the hook of the crane so as to be engageable with a heavy load, is releasably hung on the link lever. Further, a release lowers a proximal end of the lever holder to thereby release the distal end of the link lever from the distal end of the lever holder.

16 Claims, 16 Drawing Sheets

DISMOUNTING DEVICE FOR HEAVY LOAD HOISTING SLING

CROSS-REFERENCES TO RELATED APPLICATIONS

This application is a National Phase application of PCT/JP02/106198 filed Jun. 20, 2002 which claims priority, the complete disclosure of which are hereby incorporated by reference.

TECHNICAL FIELD

The present invention relates to a device for dismounting a heavy-load hoisting sling such as a wire rope, resin fiber rope, strand, chain, and the like, from a heavy load.

BACKGROUND ART

As a conventional device of this type, the present applicant has filed a patent application (matured into JP-A-7-25578) concerning a dismounting device for a heavy load hoisting member, in which top wires are provided between a base and a hook of a crane, bottom wires having foundation ends mounted on the base are engaged with wire engagement portions of a heavy load, respectively, and rings at ends of the bottom wires are fitted into a mast erected on the base. In this device, the base includes a pair of plates each formed into an approximate rectangle, a pair of side plates arranged at both margins of the plates to connect these plates at a predetermined interval, and a bottom block arranged at the bottom margin center of the paired plates. The paired plates are formed with, at centers thereof, T-shaped holes in an opposing manner, respectively, and the mast is erected on the bottom block to protrude into the T-shaped holes.

Slidably fitted onto the mast is a slider having a front end to be pushed up by a first resilient body under loadless state so that the front end fits the top of the mast, and slider lowering means is configured to lower the slider by overcoming a resilient force of the first resilient body. Further, locking means is configured to temporarily lock the slider in a lowered state of the slider, and unlocking means is configured to unlock the locked slider. Moreover, the slider lowering means includes a sensor rod which is vertically movably inserted into the base, whose bottom protrudes downward from the bottom of the base, and which is connected to the slider via tension member.

In the thus configured dismounting device, the base is firstly suspended by the hook of the crane through the top wires, and this base is lowered onto an upper surface of a heavy load or onto a ground close to the heavy load, so that the sensor rod downwardly protruded from the bottom of the base is pushed into the base, and the slider is lowered against the resilient force of the first resilient body. At this time, the locking means temporarily locks the slider in a lowered state of the slider. Next, the bottom wires are engaged with wire engagement portions of the heavy load, and then the rings at the ends of the bottom wires are fitted onto the mast through the T-shaped holes, respectively. The heavy load in this state is hoisted by the crane and unloaded at a predetermined place, and the locked slider is unlocked by the unlocking means, so that the slider is pushed up to the top of the mast by the resilient force of the first resilient body and thus the rings of the bottom wires are removed from the mast. When the base in this state is lifted by the crane, the bottom wires are removed from the wire engagement portions of the heavy load and released from the heavy load. In this way, the bottom wires can be dismounted from the heavy load by a simple operation, thereby enabling remarkable labor saving.

In the dismounting device for a heavy load hoisting member shown in the above JP-A-7-25578, it is required to create a plurality of kinds of devices from a small-sized one to a large-sized one correspondingly to heavy loads to be hoisted. However, since size increasing ratios of the rings of the bottom wires are larger than size increasing ratios of the devices as weights of heavy loads are increased, T-shaped holes of the plates are also required to be correspondingly increased in size, thereby causing a problem that the plates are to be increased in size than required.

Further, when the rings are increased in size and weight, it is also required to increase an elastic modulus of the first resilient body for pushing up the rings. This requires a larger force for lowering the slider, i.e., the whole of the device is configured such that the slider has a self-weight capable of being lowered against the resilient force of the first resilient body, thereby causing another problem that the weight of the device is increased than required.

It is therefore an object of the present invention to provide a dismounting device for a heavy load hoisting sling capable of ensuring a strength corresponding to a weight of a heavy load upon hoisting the same, thereby requiring only a minimally increased size of the device.

It is another object of the present invention to provide a dismounting device for a heavy load hoisting sling capable of assuredly preventing distal ends of link levers from being released from distal ends of lever holders when a heavy load is hoisted, and capable of allowing the slings to be readily and quickly dismounted from the heavy load when the heavy load is downed at a predetermined place.

DISCLOSURE OF TIE INVENTION

As shown in FIG. 1 and FIG. 4, the invention is an improvement of a dismounting device for a heavy load hoisting sling, comprising:

a base 16 including at its upper end a crane engagement portion 27 to be engaged with a hook 26*a* of a crane 26 or with a hook block;

a lever holder 17 pivotally connected at a substantial center thereof to a first shaft 11 affixed to the base 16 below the crane engagement portion 27;

a link lever 18 including a proximal end swingably mounted on a second shaft 12 affixed to the base 16 below the first shaft 11, and a distal end to be engaged with a distal end of the lever holder 17, in which one end of a sling 13 including the other end to be hung on the hook of the crane or on the base 16 so as to be engageable with a heavy load 14, is releasably hung on the link lever 18; and releasing means 19 for lowering a proximal end of the lever holder 17 to raise the distal end of the lever holder 17, thereby releasing the distal end of the link lever 18 from the distal end of the lever holder 17.

In the dismounting device for a heavy load hoisting sling the hook 26*a* of the crane 26 is firstly engaged with the crane engagement portion 27, and the one end of the sling 13 is hung on the hook of the crane or on the base 16. Next, the base 16 is placed just above the heavy load 14, the sling 13 is engaged with the heavy load 14 and the other end of the sling 13 is hung on the link lever 18, and then the distal end of the link lever is engaged with the distal end of the lever holder 17. When the heavy load 14 is hoisted by the crane 26, a relatively larger force by rotation moment based on a weight of the heavy load 14 is outwardly applied to the distal end of the link lever 18, i.e., applied in a direction to press the distal end of the link lever 18 against the distal end of the lever holder 17, so that a frictional force between the distal end of the link lever 18 and the distal end of the lever holder 17 is increased, thereby maintaining a state where the distal end of the link lever is engaged with the distal end of the lever holder. Next, when the heavy load 14 is downed at a predetermined place in a state where the slider 31 of the releasing means 19 is lowered and the engagement plate 31 b is engaged with the proximal end of the lever holder 17 to thereby cause the self-weight of the slider 31 to act thereon, the sling 13 is relaxed and the force acted on the distal end of the link lever 18 is removed, so that the distal end of the link lever 18 can be readily released from the distal end of the lever holder 17 by virtue of the self-weight of the slider 31. As the distal end of the link lever is released from the distal end of the lever holder, the distal end of the link lever 18 is downwardly turned. When the base 16 is lifted by the crane 26 in this state, the other end of the sling 13 is released from the link lever 18 and then the sling 13 is released from the heavy load 14 so that the sling 13 is lifted together with the base 16.

As shown in FIG. 7 and FIG. 8, the invention is characterized in that the link lever 18 includes: a proximal end portion 18*a* swingably mounted on the second shaft 12; a curved portion 18*b* provided continuously to the proximal end portion 18*a* and curved at a predetermined curvature radius; a distal end portion 18*c* engageable with the distal end of the lever holder 17; and a beam portion 18*d* connecting the curved portion 18*b* and the distal end portion 18*c* with each other; and that, when assuming:

a limit point of action P which is a position where the other end of the sling 13 contacts with the link lever 18, when the link lever 18 is turned about the second shaft 12 so that the beam portion 18*d* is brought from an upright posture to a horizontal posture, by releasing the link lever 18 from the lever holder 17, from a state where the other end of the sling 13 engaged with the heavy load 14 is hung on the link lever 18 and the distal end of the link lever 18 is engaged with the distal end of the lever holder 17;

an angle $\alpha$ which is defined between: a straight line L connecting a central point of the second shaft 12 to the limit point of action P; and an inside line of the beam portion 18*d*; and an angle $\beta$ which is defined between: a straight line M connecting a central point of the second shaft 12 to the center of gravity G of the link lever 18; and an inside line of the beam portion 18*d;* one or each of the angle $\alpha$ and angle $\beta$ is configured to be an obtuse angle.

In the dismounting device for a heavy load hoisting sling recited in Claim 2, when the angle $\alpha$ defined between the straight line L connecting the central point of the second shaft 12 to the limit point of action P and the inside line of the beam portion 18*d*, is an obtuse angle in case that the weight of the heavy load 14 is extremely larger than the self-weight of the link lever 18 and in case that the link lever 18 is released from the lever holder 17 and the base 16 is lifted so that the beam portion 18*d* is brought from an upright posture to a horizontal posture, the link lever 18 is turned in a direction to further transfer from the horizontal posture to a downward posture so that the other end of the sling 13 is released from the link lever 18. Further, when the angle $\beta$ defined between the straight line M connecting the central point of the second shaft 12 to a center of gravity G of the link lever 18, and the inside line of the beam portion 18*d*, is an obtuse angle in case that the weight of the heavy load 14 is relatively small so that the self-weight of the link lever 18 affects a rotation moment thereof and in case that the link lever 18 is released from the lever holder 17 and the base 16 is lifted so that the beam portion 18*d* is brought from an upright posture to a horizontal posture, the link lever 18 is turned in a direction to further transfer from the horizontal posture to a downward posture so that the other end of the sling 13 is released from the link lever 18.

As shown in FIG. 1 and FIG. 4, the invention is characterized in that the releasing means 19 comprises, in addition to the slider 31,:

a slider 31 vertically movably provided on the base 16 to engage with the proximal end of the lever holder 17, thereby urging the proximal end of the lever holder 17 in a direction to push down the same;

locking means 32 provided on the base 16 and engaged with the slider 31 to thereby temporarily lock the slider 31 in a raised state; and unlocking means 33 for unlocking the temporarily locked slider 31;

that when the weight of the heavy load 14 is applied to the link lever 18 through the sling 13, there is maintained a state where the distal end of the link lever 18 is engaged with the distal end of the lever holder 17; and that the slider 31 is configured to raise the distal end of the lever holder 17 to thereby release the distal end of the link lever 18 from the distal end of the lever holder 17 when the temporarily locked slider 31 is unlocked by the unlocking means 33 and the weight of the heavy load 14 is not applied to the link lever 18 through the sling 13.

In the dismounting device for a heavy load hoisting sling, the hook 26*a* of the crane 26 is firstly engaged with the crane engagement portion 27, and the one end of the sling 13 is hung on the hook of the crane or on the base 16. In this state, as the base 16 is placed just above the heavy load 14 and the slider 31 is raised, the locking means 32 temporarily locks the slider 31 in the raised state, so that the self-weight of the slider 31 is not applied to the proximal end of the lever, holder 17 thereby lowering the distal end of the lever holder 17. Next, the sling 13 is engaged with the heavy load 14, the other end of the sling is hung on the link lever 18, and the distal end of the link lever 18 is engaged with the distal end of the lever holder 17. In this state, when the heavy load 14 is hoisted by the crane 26, there is maintained the state where the distal end of the link lever 18 is engaged with the distal end of the lever holder 17 identically to Claim 1. Next, when the heavy load 14 is downed at a predetermined place, the sling 13 is relaxed and the force acted on the distal end of the link lever 18 is removed. In this state, when the locked slider 31 is unlocked by the unlocking means 33, the slider 31 is lowered and the proximal end of the lever holder 17 is pushed down by the self-weight of the slider 31, so that the distal end of the lever holder is raised and the distal end of the link lever 18 is released from the lever holder 17 to thereby downwardly turn the distal end of the link lever. Further, when the base 16 is lifted by the crane 26, the other end of the sling 13 is released from the link lever 18 and then the sling 13 is released from the heavy load 14 so that the sling 13 is lifted together with the base 16.

As shown in FIG. 1, FIG. 4, and FIG. 9, the invention is characterized in that the base 16 includes: a first plate 21 and a second plate 22 both extending vertically; and a fixing plate 24 provided between the first plate 21 and the second plate 22, to horizontally extend or to be inclined, to thereby couple the first plate 21 to the second plate 22, the fixing plate 24 being formed with a through-hole 24*a;* that the ascending/descending rod 31 a of the slider 31 is loosely inserted through the through-hole 24*a;* that the slider 31 includes an ascending/descending rod 31*a* loosely inserted through the through-hole 24*a*, and an engagement plate 31*b* which is integrally provided at an upper portion of the ascending/descending rod 31*a* and which extends horizontally or is inclined;

that the engagement plate 31*b* is configured to engage with the proximal end of the lever holder 17;

that when the weight of the heavy load 14 is applied to the link lever 18 through the sling 13, there is maintained a state where the distal end of the link lever 18 is engaged with the distal end of the lever holder 17; and that the engagement plate 31*b* is configured to raise the distal end of the lever holder 17 by self-weights of at least the ascending/descending rod 31*a* and the engagement plate 31*b* itself to thereby release the distal end of the link lever 18 from the distal end of the lever holder 17 when the weight of the heavy load 14 is not applied to the link lever 18 through the sling 13.

In the dismounting device for a heavy load hoisting sling, the hook 26*a* of the crane 26 is firstly engaged with the crane engagement portion 27, and the one end of the sling 13 is hung on the hook of the crane or on the base 16. In this state, as the base 16 is placed just above the heavy load 14 and the slider 31 is raised, the locking means 33 temporarily locks the ascending/descending rod 31*a* in the raised state, so that the self-weight of the slider 31 is not applied to the proximal end of the lever holder 17 thereby turning the lever holder 17 to a position where the distal end of the link lever 18 is engageable with the distal end of the lever holder 17. Next, the sling 13 is engaged with the heavy load 14, the other end of the sling is hung on the link lever 18, and the distal end of the link lever 18 is engaged with the distal end of the lever holder 17. In this state, when the heavy load 14 is hoisted by the crane 26, there is maintained the state where the distal end of the link lever 18 is engaged with the distal end of the lever holder 17 identically to Claim 1. At this time, the locked slider 31 is unlocked by the unlocking means 33 and the slider 31 is lowered, so that at least the self-weight of the slider 31 acts on the proximal end of the lever holder 17. However, since the frictional force between the distal end of the link lever 18 and the distal end of the lever holder 17 is much larger than the self-weight of the slider 31, the distal end of the link lever 18 is not disengaged from the distal end of the lever holder 17 even when the self-weight of the slider 31 acts on the proximal end of the lever holder 17. Next, when the heavy load 14 is downed at a predetermined place, the sling 13 is relaxed and the force acted on the distal end of the link lever 18 is removed, so that the proximal end of the lever holder 17 is pushed down by at least the self-weight of the slider 31. Thus, the distal end of the lever holder 17 is raised and the distal end of the link lever 18 is released from the lever holder 17, so that the distal end of the link lever 18 is turned downwardly. In this state, when the base 16 is lifted by the crane 26, the other end of the sling 13 is released from the link lever 18 and then the sling 13 is released from the heavy load 14 so that the sling 13 is lifted together with the base 16.

As shown in FIG. 1 and FIG. 4, the invention of Claim 5 according to Claim 3 is characterized in that the locking means 32 comprises an adjustable bar 34 having an elongated engagement hole 34*a* through which the slider 31 is vertically movably fitted, the adjustable bar 34 being provided on the base 16 in a manner to be swingable in a vertical plane and slidable in a longitudinal direction of the adjustable bar 34 in the fitted state;

that the slider 31 is configured to be engaged with edges of the elongated engagement hole 34*a* when the adjustable bar 34 is brought to a predetermined inclination angle; and that the unlocking means 33 comprises an arm 36 which is pivotally connected to the base 16 so as to contact with the adjustable bar 34 and which is adapted to move the adjustable bar 34 in a direction to release the slider 31 from the adjustable bar 34.

In the dismounting device for a heavy load hoisting sling recited in Claim 5, when the slider 31 is raised, the slider 31 is temporarily locked by the adjustable bar 34 in the raised state of the slider, and the temporarily locked slider 31 is quickly unlocked when the adjustable bar 34 is moved in a predetermined direction by turning the arm 36. As a result, the distal end of the link lever 18 is prevented from being released from the distal end of the lever holder 17 when the heavy load 14 is hoisted, and the sling 13 can be readily and quickly dismounted from the heavy load 14 when the heavy load 14 is downed at a predetermined place.

As shown in FIG. 1, FIG. 4, and FIG. 10, the invention of Claim 6 according to Claim 3 is characterized in that the locking means 32 comprises a first magnet 41 adapted to retain the slider 31 in a raised state by a magnetic force and to release the slider 31 by erasing the magnetic force; and that the unlocking means 33 comprises: first switchover means 51 for generating or erasing the magnetic force of the first magnet 41; and remote control means 37 for remotely controlling the first switchover means 51 to thereby control the first magnet 41.

In the dismounting device for a heavy load hoisting sling recited in Claim 6, when the slider 31 is raised, and the slider in the raised state is temporarily locked by the magnetic force of the first magnet 41. As a result, the distal end of the link lever 18 is prevented from being released from the distal end of the lever holder 17 when the heavy load 14 is hoisted. By remotely controlling the first switchover means 51 by the remote control means 37 to thereby erase the magnetic force of the first magnet 41 after hoisting the heavy load 14 by the crane 26 and downing it at a remote place, the temporarily locked slider 31 is released. As a result, the slider 31 is lowered and the distal end of the link lever 18 is released from the distal end of the lever holder 17, thereby enabling the sling 13 to be quickly dismounted from the heavy load 14.

As shown in FIG. 1 and FIG. 4, the invention of Claim 7 according to Claim 5 is characterized in that the dismounting device further comprises: a second magnet 42 configured to retain the arm 36 by a magnetic force in a state where the adjustable bar 34 is engaged with the slider 31; a resilient body 61 configured to urge the arm 36 in a direction to release the slider 31 from the adjustable bar 34; second switchover means 52 for generating or erasing the magnetic force of the second magnet 42; and remote control means 37 for remotely controlling the second switchover means 52 to thereby control the second magnet 42.

In the dismounting device for a heavy load hoisting sling recited in Claim 7, when the slider 31 is raised while attracting the arm 36 by the magnetic force of the second magnet 42, the slider 31 is raised while maintaining the state where the adjustable bar 34 is engaged with the slider 31, so that the slider 31 at the uppermost position is temporarily locked by the adjustable bar 34. Meanwhile, by remotely controlling the second switchover means 52 by the remote control means 37 to thereby erase the magnetic force of the second magnet 42, the arm 36 is turned by the resilient force of the resilient body 61, so that the adjustable bar 34 is moved in a predetermined direction to thereby release the slider 31 from the adjustable bar 34. As a result, the slider 31 is quickly lowered.

As shown in FIG. 1, the invention of Claim 8 according to Claim 1 is characterized in that the dismounting device further comprises a handle 48 which is protruded from the distal end of the lever holder 17 and which can be gripped by a human worker.

In the dismounting device for a heavy load hoisting sling recited in Claim 8, by lowering the distal end of the lever holder 17 by gripping the handle 48, the slider 31 engaged with the proximal end of the lever holder 17 is raised and the distal end of the link lever 18 can be engaged with the distal end of the lever holder 17.

BEST MODE FOR CARRYING OUT THE INVENTION

There will be explained a first embodiment of the present invention based on the drawings.

Figure 1:
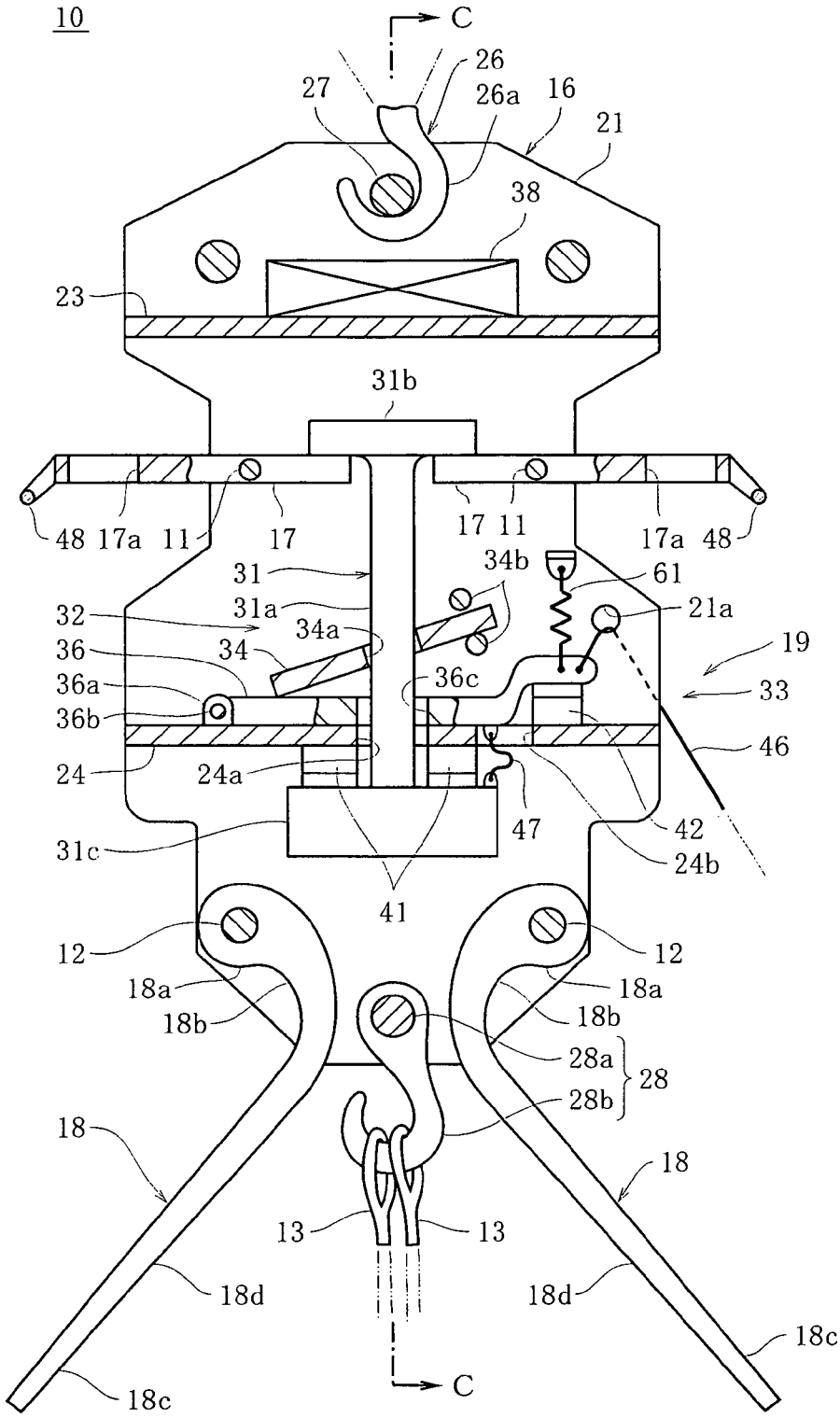
FIG. 1 is a cross-sectional view of a dismounting device for a heavy load hoisting sling according to a first embodiment of the present invention taken along a line A-A of FIG. 9.
Figure 4:
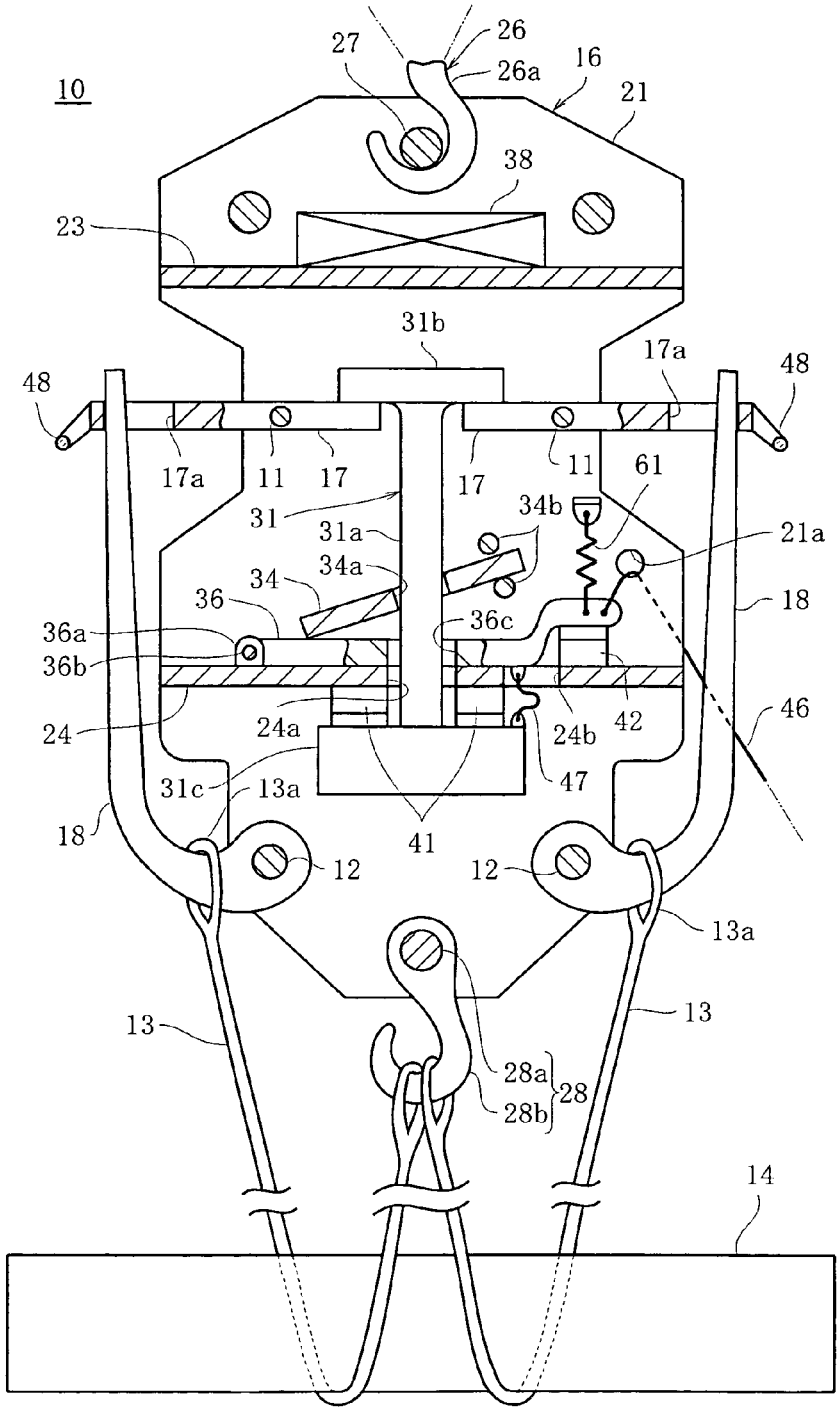
FIG. 4 is a cross-sectional view corresponding to FIG. 1 and showing a situation where the concrete column is hoisted.

As shown in FIG. 1 and FIG. 4, reference numeral 10 designates a dismounting device for slings 13 for hoisting a heavy load 14, and the dismounting device 10 comprises: a base 16; a pair of lever holders 17,17 pivotally connected at substantial centers thereof to a pair of first shafts 11, 11, respectively, affixed to the base; a pair of link levers 18, 18 having proximal ends swingably mounted on a pair of second shafts 12, respectively, affixed to the base 16; and releasing means 19 for releasing the distal ends of the link levers from the distal ends of the lever holders 17, respectively. The heavy load 14 is a concrete column, in this embodiment. Further, the sling 13 in the present specification conceptually embraces: a resin fiber rope such as a nylon rope; a strand; and a chain; in addition to a wire rope.

Figure 9:
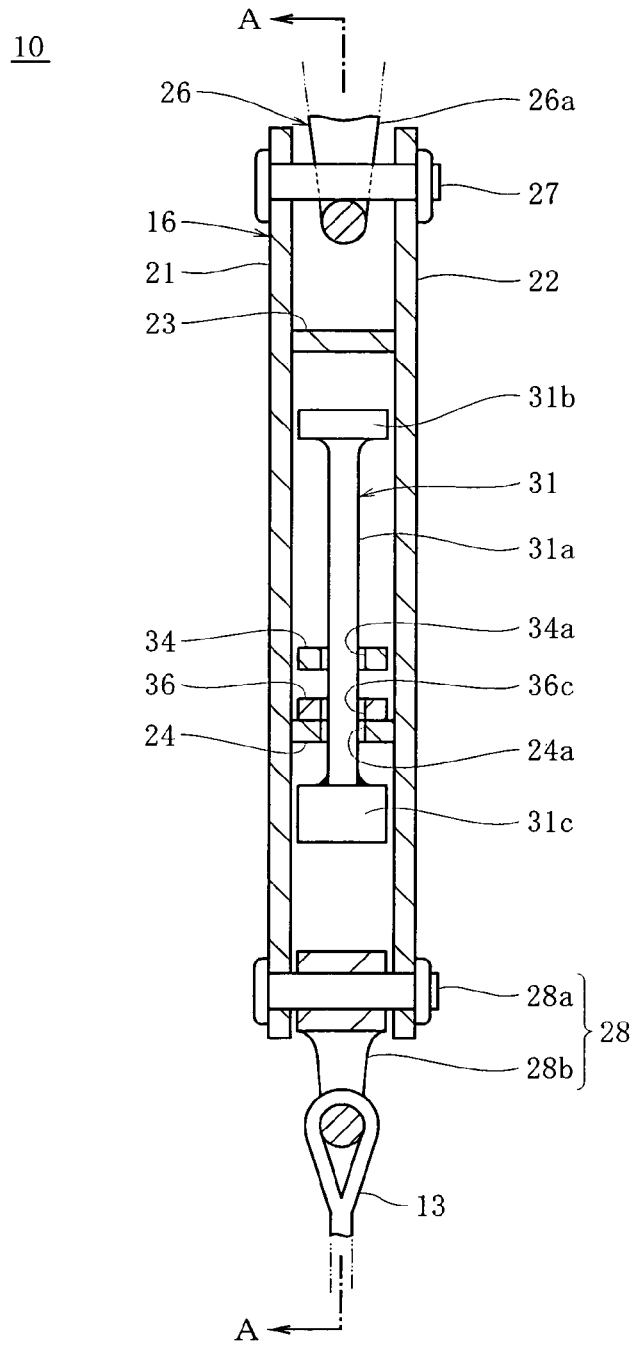
FIG. 9 is a cross-sectional view taken along a line C-C of FIG. 1.

The base 16 includes first and second plates 21, 22 formed by cutting a steel plate into substantially rectangular shapes, respectively, and an upper plate 23 and a fixing plate 24 provided to horizontally extend at upper portions and central portions of the first and second plates and between them, respectively, so as to join the first and second plates to each other at a predetermined spacing (FIG. 1 and FIG. 9). Provided at a central portion of an upper end of the base 16 is a crane engagement portion 27 to be engaged by a hook 26*a* of a crane 26, and provided at a central portion of a lower end of the base 16 is a sling hanging portion 28 on which one ends of the slings 13 engaged with the concrete column 14 are hung. The sling hanging portion 28 includes a first pin 28*a* affixed to the base 16, and a sling hook 28*b* having an upper end loosely fitted on the first pin and a lower end on which one ends of the slings 13 are hung. The crane engagement portion 27 and first pin 28*a* are each formed of a column-like steel material. Further, formed at a central portion of the fixing plate 24 is a through-hole 24*a*.

Figure 11:
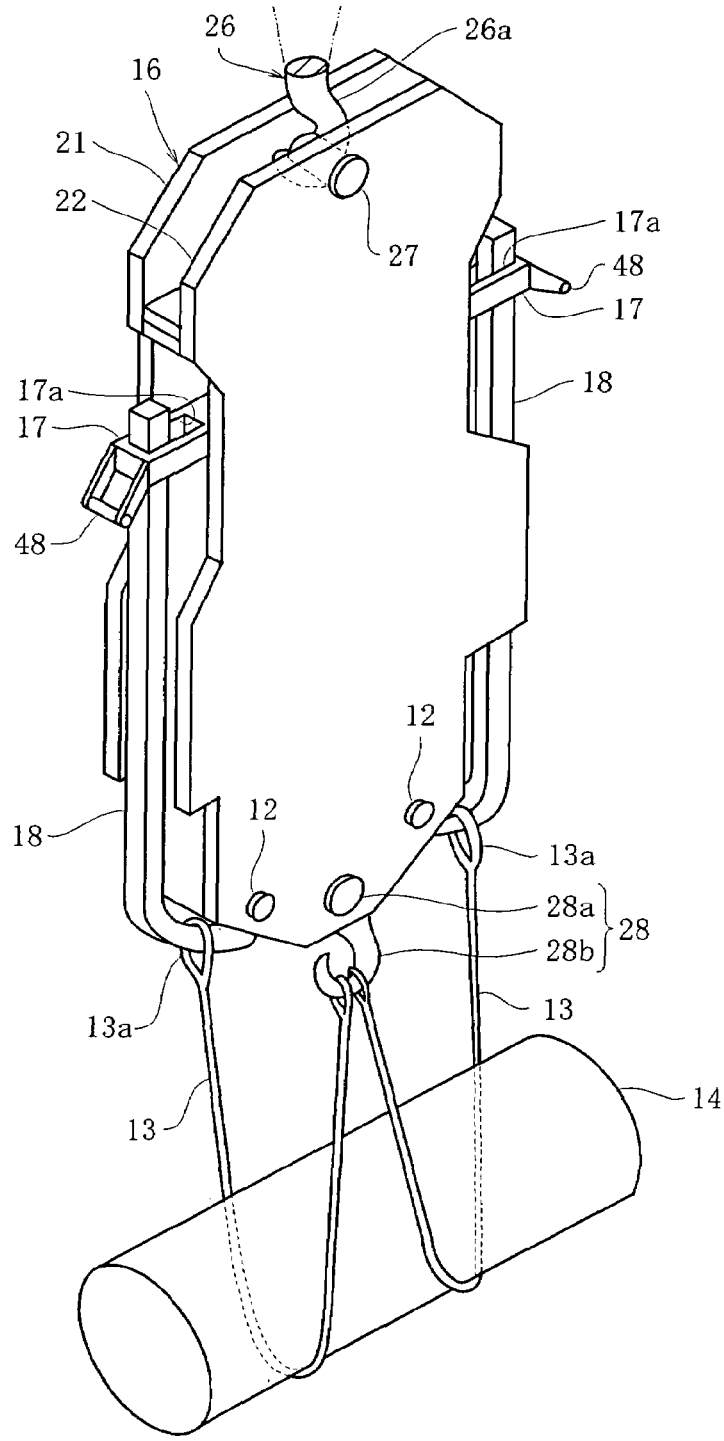
FIG. 11 is a perspective view of a situation where the concrete column is hoisted by the hoisting device.

The paired first shafts 11, 11 are affixed to the base 16 at a predetermined spacing in a horizontal direction, between the upper plate 23 and fixing plate 24 (FIG. 1). Further, the paired lever holders 17, 17 are pivotally connected to the first shafts 11, 11 such that distal end sides of the lever holders are heavier than proximal end sides thereof, i.e., the distal ends are lowered in a loadless state. Concretely, the paired lever holders 17, 17 are configured such that portions thereof closer to proximal ends from central portions in the longitudinal direction of the lever holders are swingably fitted on the paired first shafts 11, 11, respectively, and such that the distal ends of the lever holders 17, 17 are protruded in a leftward outer direction and a rightward outer direction from the first and second plates 21, 22, respectively. Further, the distal ends of the paired lever holders 17, 17 are formed with elongated insertion holes 17*a*, 17*a* extending in a longitudinal direction of the lever holders, respectively (FIG. 1, FIG. 9, and FIG. 11).

Figure 3:
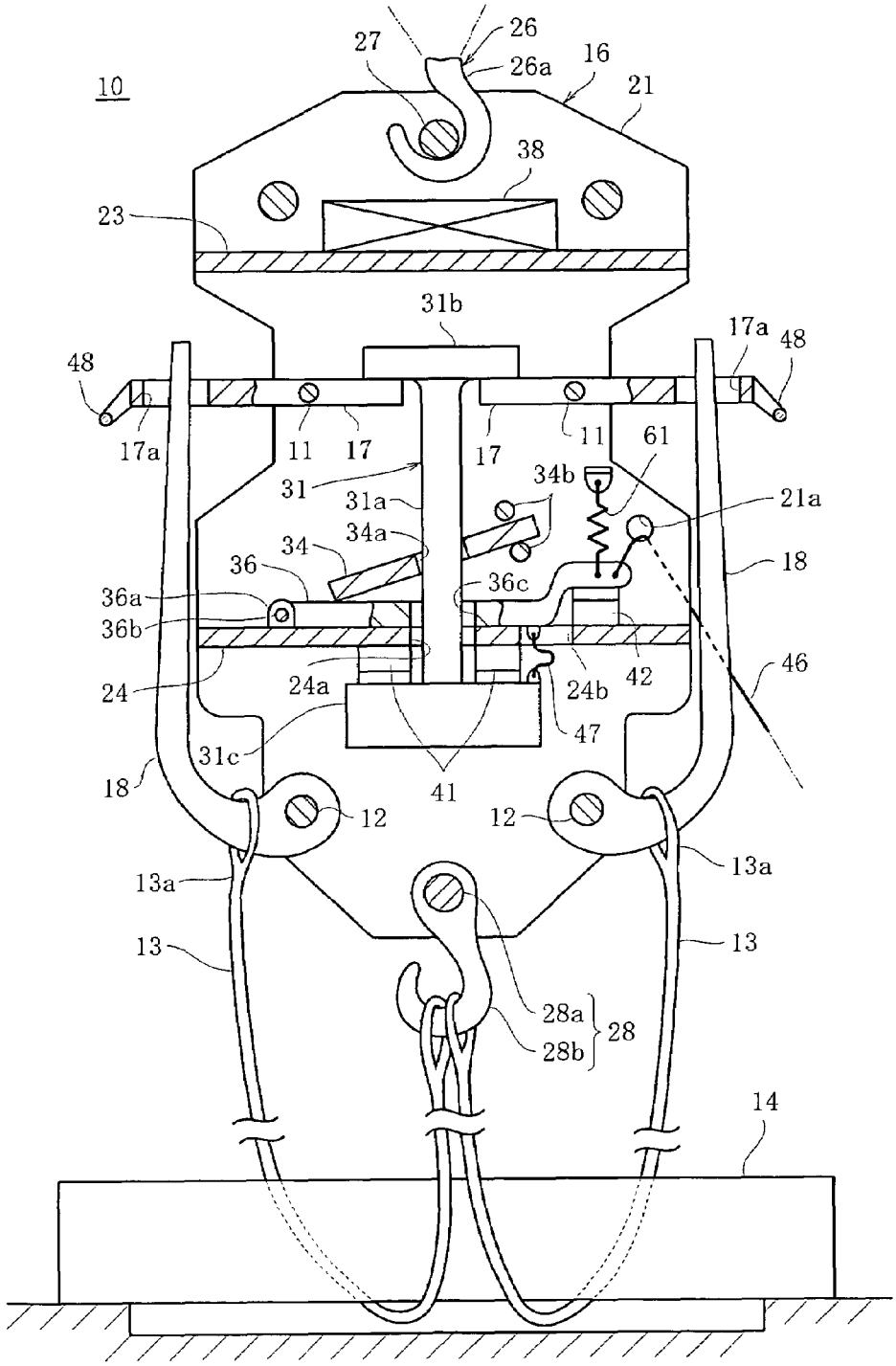
FIG. 3 is a cross-sectional view corresponding to FIG. 1 and showing a situation where the distal ends of the link levers are engaged with distal ends of lever holders, respectively.

The paired second shafts 12, 12 are affixed to the base 16 near the sling hanging portion 28, at a predetermined spacing in a horizontal direction (FIG. 1). The paired link levers 18, 18 are formed in substantially J-shapes, respectively, and are configured such that distal ends of the link levers 18, 18 are engaged with the distal ends of the paired lever holders 17, 17, respectively, by upwardly turning the distal ends of the link levers 18, 18 and by inserting these distal ends into the elongated insertion holes 17*a*, 17*a* at the distal ends of the paired lever holders 17, 17, respectively (FIG. 3 and FIG. 4). Further, the link levers 18 are so configured that rings 13*a* formed at other ends of the slings 13 are allowed to be fitted on the link levers 18, respectively.

Figure 7:
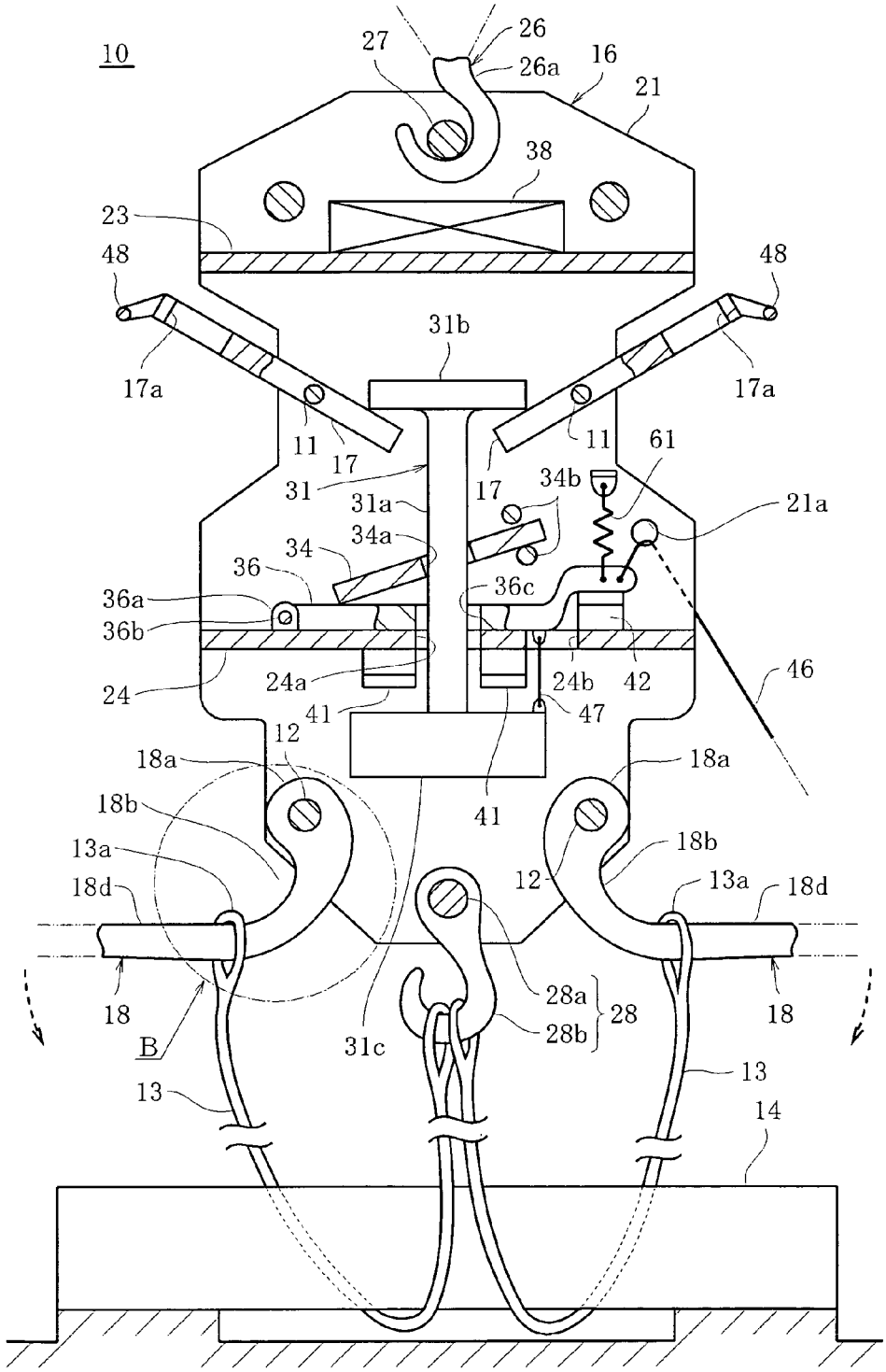
FIG. 7 is a cross-sectional view corresponding to FIG. 1 and showing a situation where distal ends of the link levers are released from distal ends of the lever holders so that the link levers are turned downwardly—should be inserted.

The releasing means 19 comprises a slider 31 provided on the base 16 in a vertically movable manner, locking means 32 configured to engage with the slider to temporarily lock the slider in a raised state, and unlocking means 33 for unlocking the temporarily locked slider. The slider 31 includes an ascending/descending rod 31*a* loosely inserted through the through-hole 24*a* of the fixing plate 24, a horizontally extending engagement plate 31*b* integrally provided at an upper portion of the ascending/descending rod, and a weight 31*c* attached to a lower end of the ascending/descending rod (FIG. 1 and FIG. 9). The engagement plate 31*b* is configured to engage with the proximal ends of the paired lever holders 17, 17 to push down these proximal ends, when the slider 31 is lowered (FIG. 7).

The locking means 32 comprises an adjustable bar 34 having an elongated engagement hole 34*a* through which the slider 31 is vertically movably and loosely fitted, and a pair of first magnet 41, 41 configured to retain the slider 31 by magnetic forces in a state where the slider 31 is raised (FIG. 1 and FIG. 9). The adjustable bar 34 is formed of a flat bar, and is provided on the base 16 such that the adjustable bar 34 is swingable in a vertical plane and slidable in a longitudinal direction of the adjustable bar in a state where the adjustable bar is loosely fitted on the ascending/descending rod 31*a*. Further, the elongated engagement hole 34*a* is formed at the center of the adjustable bar 34, and has a length formed to be slightly longer than a width of the ascending/descending rod 31*a*. The adjustable bar 34 includes: one end which is to be placed on an arm 36 to be described later near a proximal end of the arm, or which is kept in a state slightly floated from the arm; and the other end movably inserted between a pair of second pins 34*b*, 34*b* affixed to the base 16 above the fixing plate 24. The ascending/descending rod 31*a* is configured to be engaged with edges of the elongated engagement hole 34*a*, when the adjustable bar 34 is brought to a predetermined inclination angle. Namely, the ascending/descending rod 31*a* is configured to be temporarily locked in a state where the ascending/descending rod is raised, when the adjustable bar 34 is turned about the lower second pin 34*b* and moved in a longitudinal direction of the adjustable bar so that widthwise side edges of the ascending/descending rod 31*a* are engaged with both end edges of the elongated engagement hole 34*a*, respectively. Further, the paired first magnet 41, 41 are configured with electromagnets, respectively, which generate and lose magnetic forces upon energization and de-energization, respectively, and which are attached to a lower surface of the fixing plate 24 to oppose to the weight 31*c*.

Figure 10:
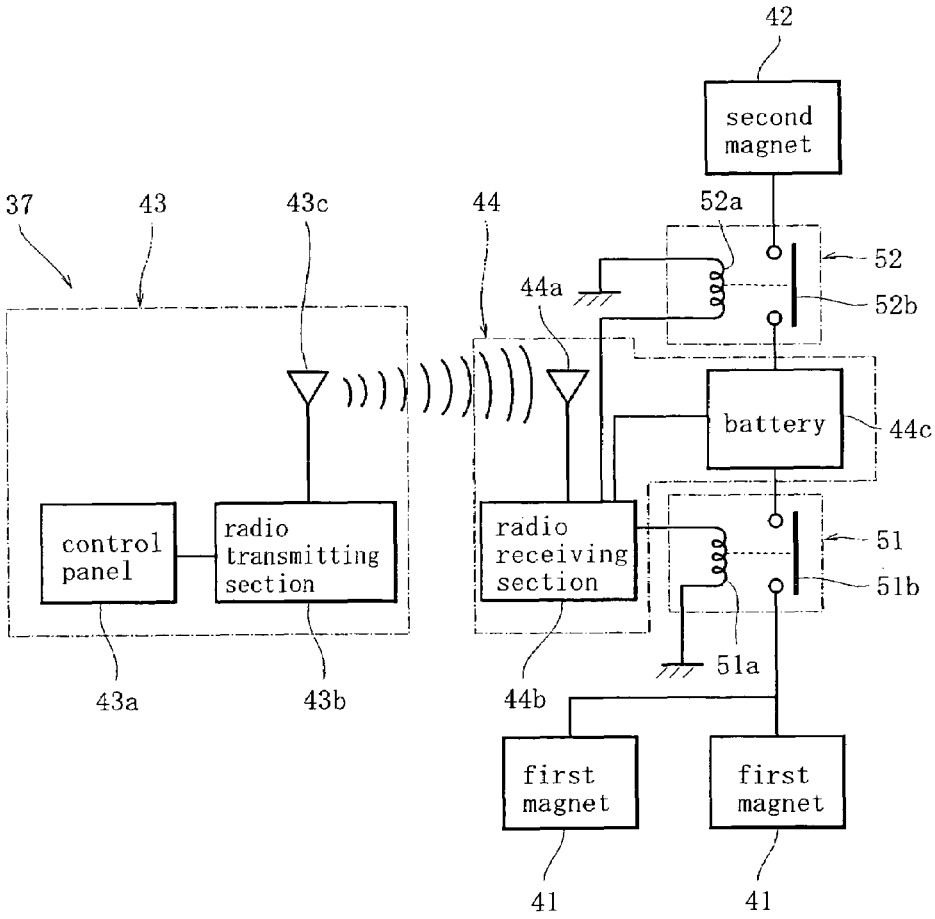
FIG. 10 is a constitutional view of remote control means for remotely controlling the first magnets and second magnet.

The unlocking means 33 comprises: the arm 36 adapted to move the adjustable bar 34 in a direction to release the slider 31 from the adjustable bar 34; first switchover means 51 for generating and erasing magnetic forces of the first magnets 41; and remote control means 37 for remotely controlling the first switchover means to thereby control the first magnets 41 (FIG. 1, FIG. 9, and FIG. 10). The proximal end of the arm 36 is swingably mounted on a third pin 36*b* of a first bracket 36*a* mounted on the fixing plate 24, so that the arm 36 is disposed in a state resting on the fixing plate 24 (FIG. 1). The arm 36 is formed with a through-hole 36*c* at the center of the arm, through which the ascending/descending rod 31*a* is loosely inserted. The first switchover means 51 is an electromagnetic relay including a coil portion 51*a* and a switch portion 51*b* (FIG. 10). When the coil portion 51*a* of the first switchover means 51 is energized, the switch portion 51*b* is turned on to cause electric current to flow through the first magnets 41 to thereby generate magnetic forces. When the coil portion 51*a* of the first switchover means 51 is de-energized, the switch portion 51*b* is turned off and electric current does not flow through the first magnets 41, so that magnetic forces of the first magnets are erased. Note that the first switchover means 51 is accommodated within a box 38 (FIG. 1) placed on the upper plate 23.

The remote control means 37 comprises a transmitter 43 provided remotely from the base 16, and a receiver 44 accommodated within the box 38 (FIG. 1 and FIG. 10). The transmitter 43 includes a control panel 43*a*, a radio transmitting section 43*b* connected to the control panel, and a transmitting antenna 43*c* connected to an output of the radio transmitting section. The receiver 44 includes a receiving antenna 44*a*, a radio receiving section 44*b* having an input connected to the receiving antenna, and a battery 44*c*. The control panel 43*a* is provided with a switch (not shown) operable by a human worker, and the radio receiving section 44*b* has an output connected with the coil portion 51*a* of the first switchover means 51. Further, the battery 44*c* is directly connected to the radio receiving section 44*b*, and connected to the paired first magnet 41, 41 through the switch portion 51*b* of the first switchover means 51.

The fixing plate 24 carries a second magnet 42 thereon, and the second magnet has an upper surface configured to be contacted with a lower surface of a distal end of the arm 36 bent in a crank shape (FIG. 1). The second magnet 42 includes a permanent magnet and an electromagnet (both not shown), and is configured such that the arm 36 is held by a magnetic force of the permanent magnet when the electromagnet is de-energized, while the magnetic force of the permanent magnet is nullified by a magnetic force of the electromagnet when the electromagnet is energized. Further, the electromagnet of the second magnet 42 is connected to the battery 44*c* through a switch portion 52*b* of the second switchover means 52 (FIG. 10). The second switchover means 52 is an electromagnetic relay having a coil portion 52*a* and the switch portion 52*b*, and the coil portion 52*a* is connected to an output of the radio receiving section 44*b*. Namely, the second switchover means 52 is configured to be remotely controlled by the remote control means 37. The second switchover means 52 is configured such that, when the coil portion 52*a* of the second switchover means 52 is energized, the switch portion 52*b* is turned on to cause electric current to flow through the electromagnet of the second magnet 42 so that the magnetic forces of the permanent magnet and electromagnet of the second magnet are nullified by each other to thereby release the arm 36. Meanwhile, the second switchover means 52 is configured such that, when the coil portion 52*a* of the second switchover means 52 is de-energized, the switch portion 52*b* is turned off and electric current does not flow through the electromagnet of the second magnet 42 so that the arm 36 is held by the magnetic force of the second magnet. Note that the second switchover means 52 is accommodated within the box 38 (FIG. 1).

Tensioned between a portion of the arm 36 near its distal end and the first plate 21 is a resilient body 61 (FIG. 1) configured to urge the arm 36 in a direction to release the slider 31 from the adjustable bar 34 when the magnetic force of the second magnet 42 is erased. In this embodiment, the resilient body 61 is a pulling coil spring. Further, the first plate 21 is formed with a through-hole 21*a* positioned above the distal end of the arm 36, and the distal end of the arm 36 has an operating rope 46 attached thereto. This rope 46 is passed through the through-hole 21*a* and arranged outside the base 16, and is used for unlocking the slider 31 from the adjustable bar 34 in emergency by pulling the rope 46 in case of trouble such as breakage of the resilient body 61 or a linear member 47 to be described later. Note that the resilient body 61 may be a compression coil spring or a rubber.

Figure 6:
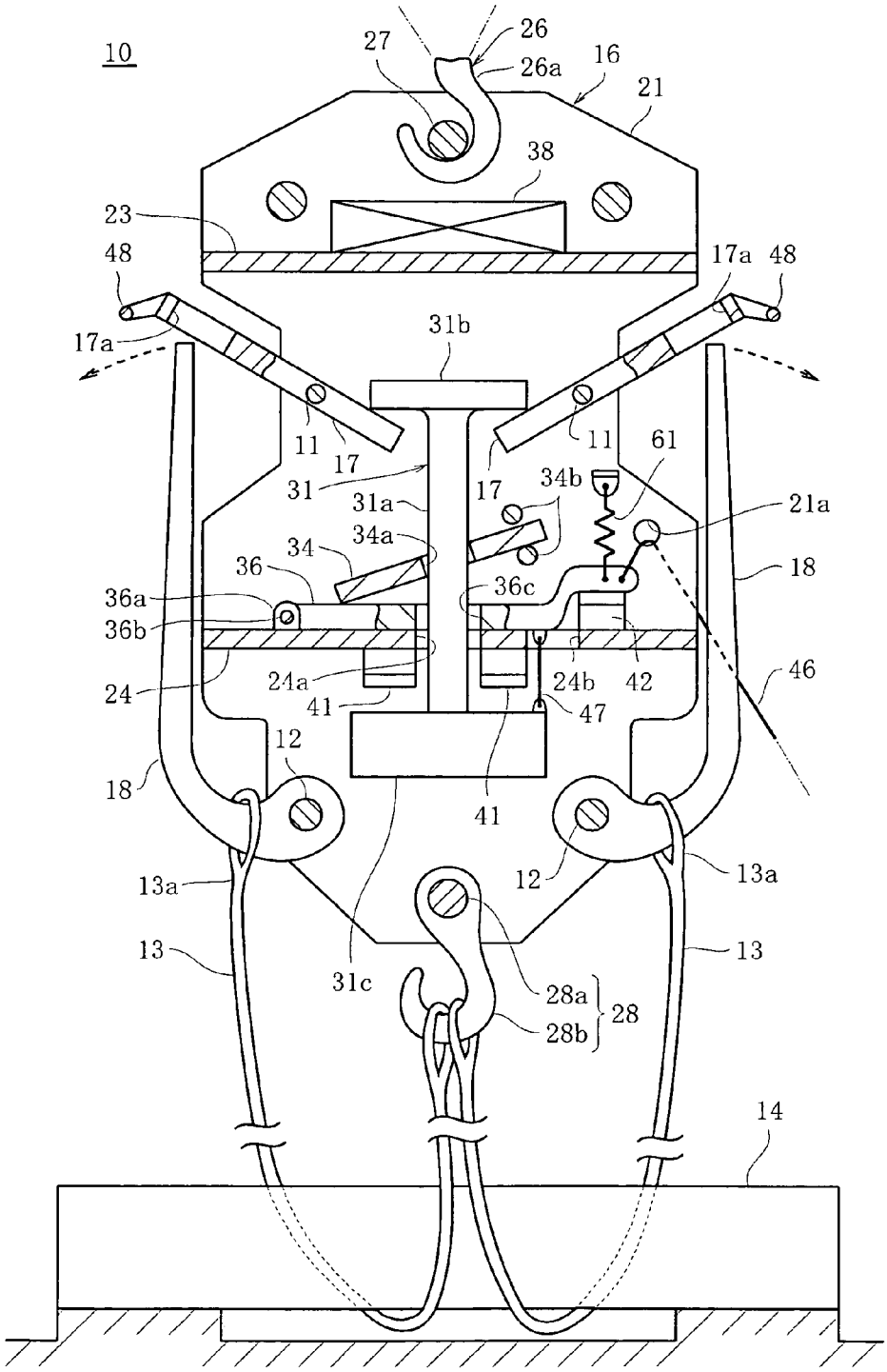
FIG. 6 is a cross-sectional view corresponding to FIG. 1 and showing a situation where a distal ends of the link levers are raised so that distal ends of the link levers are released from distal ends of the lever holders when the slider is moved downwardly by erasing a magnetic force of a first magnet—should be inserted.

The weight 31*c* of the slider 31 and the arm 36 are coupled to each other by the linear member 47 having flexibility (FIG. 1 and FIG. 6). The linear member 47 is formed of a shape memory alloy in this embodiment, is linearly stretched when a tension is acting on both ends of the linear member (FIG. 6), and is kept in a sideways fallen U-shape when the tension on both ends are released (FIG. 1). Further, the linear member 47 passes through a through-hole 24*b* formed through the fixing plate 24, and the linear member 47 has a length configured such that the arm 36 contacts with an upper surface of the second magnet 42 when the slider 31 is lowered down to a substantially lowermost position thereof (FIG. 6). Note that the lever holders 17 have distal end surfaces provided with protruded handles 48, respectively, which can be gripped by a human worker (FIG. 1).

Figure 8:
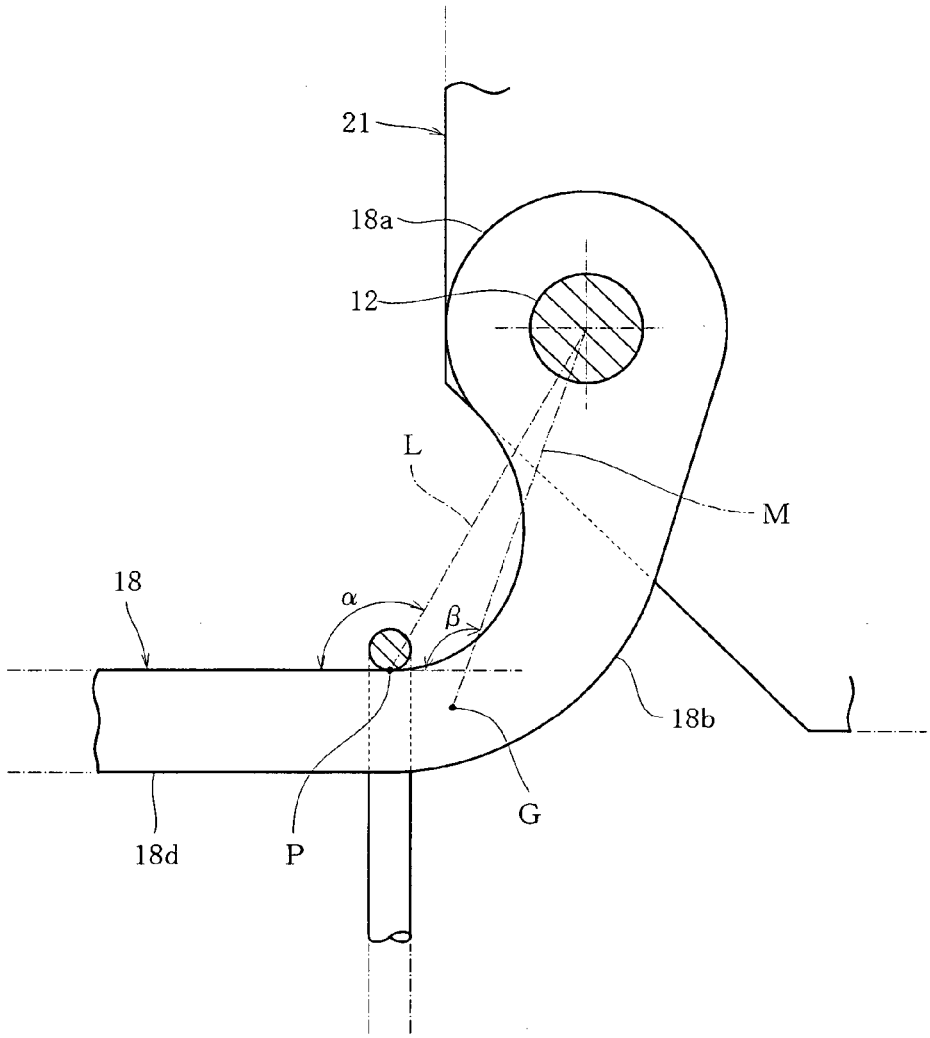
FIG. 8 is an enlarged view of an area B in FIG. 7.

Meanwhile, as shown in FIG. 1, FIG. 7, and FIG. 8 in detail, the link levers 18 each include a proximal end portion 18*a* swingably mounted on the associated second shaft 12, a curved portion 18*b* provided continuously to the proximal end portion and curved at a predetermined curvature radius, a distal end portion 18*c* engageable with the distal end of the associated lever holder 17, and a beam portion 18*d* connecting the curved portion 18*b* and distal end portion 18*c* with each other. Note that FIG. 8 shows a limit point of action P and a point G which is a center of gravity of the link lever 18. The limit point of action P means a position where the other end of the applicable sling 13 contacts with the associated link lever 18, when the link lever 18 is turned about the associated second shaft 12 so that the associated beam portion 18*d* is brought from an upright posture to a horizontal posture, by releasing the link lever from the associated lever holder 17 or by lifting the base after releasing the link lever from the lever holder, from a state where the other end of the applicable sling 13 engaged with the heavy load 14 is hung on the associated link lever 18 and the distal end of the link lever 18 is engaged with the distal end of the associated lever holder 17.

There will be explained an operation of the sling dismounting device 10 configured in the above manner.

Firstly, the hook 26*a* of the crane 26 is engaged with the crane engagement portion 27, and one ends of the slings 13 are hung on the sling hook 28*b* of the sling hanging portion 28. Then, the switch (not shown) of the control panel 43*a* of the transmitter 43 of the remote control means 37 is operated to turn on the switch portion 51*b* of the first switchover means 51, to thereby turn off the switch portion 52*b* of the second switchover means 52. In this state, the base 16 is positioned just above the concrete column 14. At this time, the distal ends of the link levers 18 are positioned below the proximal ends thereof, respectively, and the handles 48 at the distal ends of the lever holders 17 are gripped and the distal ends of the lever holders 17 are lowered, respectively, so that the slider 31 engaged with the proximal ends of the lever holders 17 is raised. Further, since the ascending/descending rod 31*a* is engaged with edges of the elongated engagement hole 34*a* of the adjustable bar 34 and electric current is flowing through the first magnets 41, the weight 31*c* is held by the magnetic forces of the first magnets when the slider 31 is raised, so that the slider 31 is temporarily locked in the raised state and the second magnet 42 holds the arm 36 by the magnetic force of the permanent magnet (FIG. 1). When the operator disengages his/her hands from the handles 48, upper surfaces of the proximal ends of the lever holders 17 abut on the engagement plate 31*b* so that the lever holders 17 are held substantially horizontally by virtue of balancing relationships about the first shafts 11, respectively.

Figure 2:
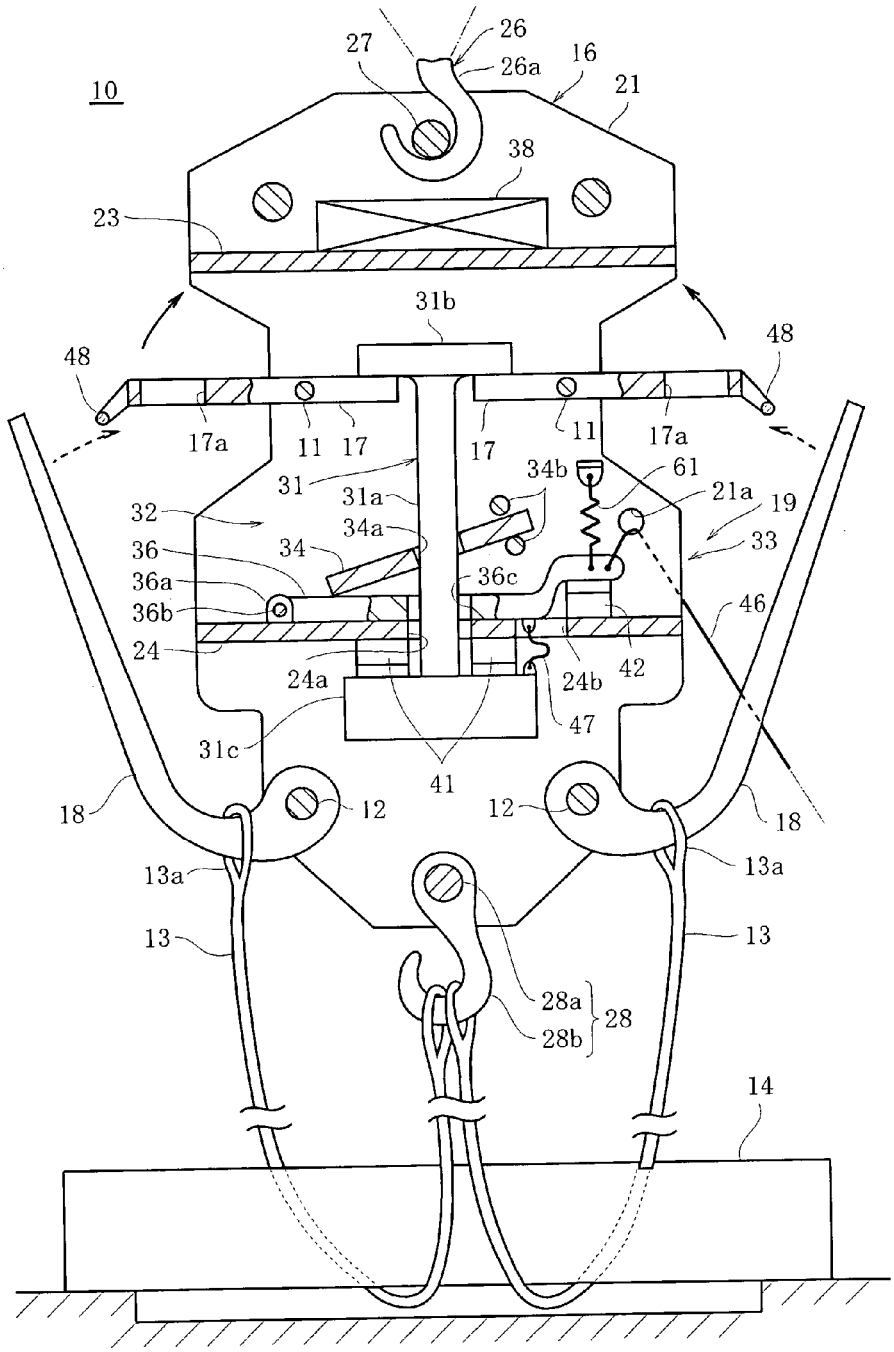
FIG. 2 is a cross-sectional view corresponding to FIG. 1 and showing a situation where slings are looped around a concrete column, rings of the slings are then fitted onto link levers, and distal ends of the link levers are turned upwardly.

In this state, the slings 13 are passed beneath the concrete column 14 and engaged therewith, the rings 13*a* at the other ends of the slings are then fitted onto the link levers 18, respectively, and thereafter the link levers are turned upwardly about the second shafts 12, respectively (FIG. 2). Next, the handles 48 are gripped and the distal ends of the lever holders 17 are raised in directions of arrows in FIG. 2, such that the distal ends of the link levers 18 are inserted into the elongated insertion holes 17*a* of the lever holders 17, respectively. This causes the distal ends of the link levers 18 to be engaged with the distal ends of the lever holders 17, respectively (FIG. 3).

Thereafter, when the concrete column 14 is hoisted (FIG. 4) by the crane 26 through the hook 26*a* of the crane 26, the base 16, and the slings 13, the weight of the concrete column 14 is applied to the link levers 18, i.e., relatively larger forces by rotation moment based on the weight of the concrete column 14 outwardly act on the distal ends of the link levers 18, respectively, so that the distal ends of the link levers 18 are pressed against inner end surfaces of the elongated insertion holes 17*a* of the lever holders 17, respectively. This increases frictional forces between the distal ends of the link levers 18 and the distal ends of the lever holders 17, respectively, so that the distal ends of the link levers 18 are brought into states engaged with the distal ends of the lever holders 17, respectively.

Figure 5:
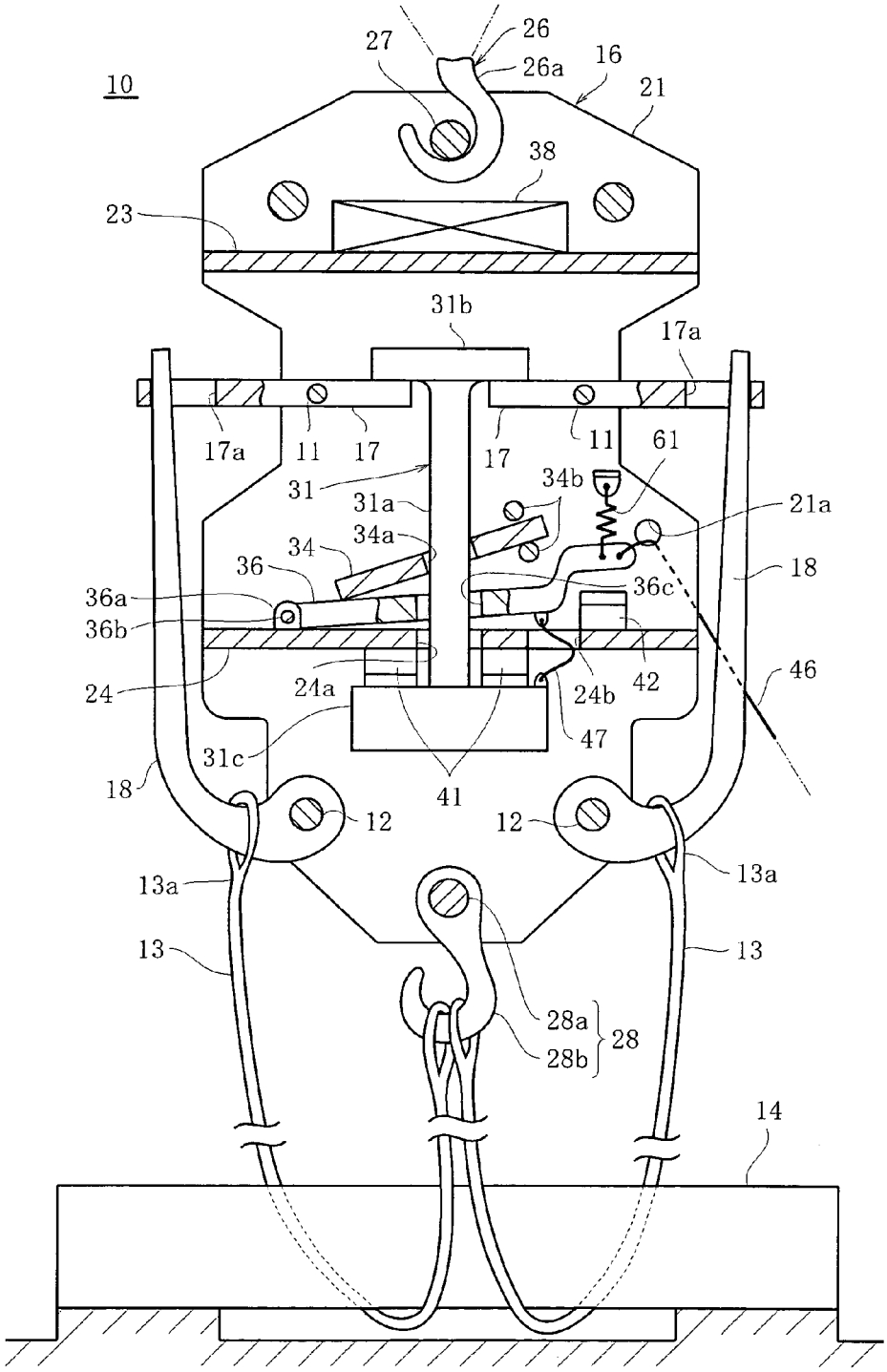
FIG. 5 is a cross-sectional view corresponding to FIG. 1 and showing a situation where a slider is released from an adjustable bar by a resilient body, when the concrete column is downed at a predetermined place and a magnetic force of a second magnet is erased.

When the concrete column 14 is downed at a predetermined place (FIG. 5), the slings 13 are relaxed to thereby remove the relatively larger forces having outwardly acted on the distal ends of the link levers 18. In this state, when the switch portion 52*b* of the second switchover means 52 is turned on by a remote operation, electric current is flowed through the electromagnet of the second magnet 42, so that magnetic forces of the permanent magnet and electromagnet of the second magnet nullify each other to release the arm 36. Thus, the arm 36 is turned upwardly around the third pin 36*b* by virtue of the resilient force of the resilient body 61, and the proximal end of the adjustable bar 34 is raised (FIG. 5), thereby releasing the engagement of the ascending/descending rod 31*a* with the edges of the elongated engagement hole 34*a*. Namely, the slider 31 is released from the adjustable bar 34.

When the switch portion 51*b* of the first switchover means 51 is turned off by the remote operation substantially at the same time as the switch portion 52*b* of the second switchover means 52 is turned on by the remote operation, magnetic forces of the first magnets 41 are erased, so that the slider 31 is lowered and the engagement plate 31*b* pushes down the proximal ends of the lever holders 17 (FIG. 6). Thus, the linear member 47 is stretched to downwardly pull the distal end of the arm 36 to thereby cause the distal end of the arm 36 to abut on the upper surface of the second magnet 42 so that the adjustable bar 34 is engaged with the slider 31, while the distal ends of the lever holders 17 are raised so that the distal ends of the link levers 18 are allowed to be removed from the elongated insertion holes 17*a*, respectively.

In case that the weight of the concrete column 14 is extremely heavier than the self-weights of the link levers 18 in the above, the distal ends of the link levers 18 are turned downwardly around the second shafts 12, respectively, before the base 16 is lifted by the crane 26 or when the base 16 is lifted. When the beam portions 18*d* are transferred from upright postures to horizontal postures (FIG. 7), respectively, the beam portions 18*d* of the link levers 18 are turned in directions for further transferring from the horizontal postures to downward postures if there is attained an obtuse angle by an angle α defined between: a straight line L connecting a central point of each second shaft 12 to the associated limit point of action P; and an inside line of the associated beam portion 18*d*; so that the rings 13*a* of the slings 13 are removed from the link levers 18, respectively.

Contrary, in case that the weight of the concrete column 14 is relatively small so that the self-weights of the link levers 18 affect rotation moments thereof, the distal ends of the link levers 18 are turned downwardly around the second shafts 12, respectively, before the base 16 is lifted by the crane 26 or when the base 16 is lifted. When the beam portion 18*d* are transferred from upright postures to horizontal postures (FIG. 7), respectively, the beam portions 18*d* of the link levers 18 are turned in directions for further transferring from the horizontal postures to downward postures if there is attained an obtuse angle by an angle β defined between: a straight line M connecting a central point of each second shaft 12 to a center of gravity G of the associated link lever 18; and an inside line of the associated beam portion 18*d*; so that the rings 13*a* of the slings 13 are removed from the link levers 18, respectively.

Further, as the base 16 is lifted by the crane 26, the slings 13 are released from the concrete column 14 and lifted together with the base 16. In this way, the slings 13 are allowed to be automatically dismounted from the concrete column 14 downed at a predetermined place.

Note that the switch portion 52*b* is turned off by a remote operation just after the switch portion 51*b* of the second switchover means 52 is turned on by the remote operation such that the linear member 47 is stretched as the slider 31 is lowered to thereby downwardly pull the distal end of the arm 36, so that the distal end of the arm 36 is attracted to the second magnet 42 by the magnetic force thereof and the adjustable bar 34 is engaged with the slider 31 (FIG. 7).

Figure 12:
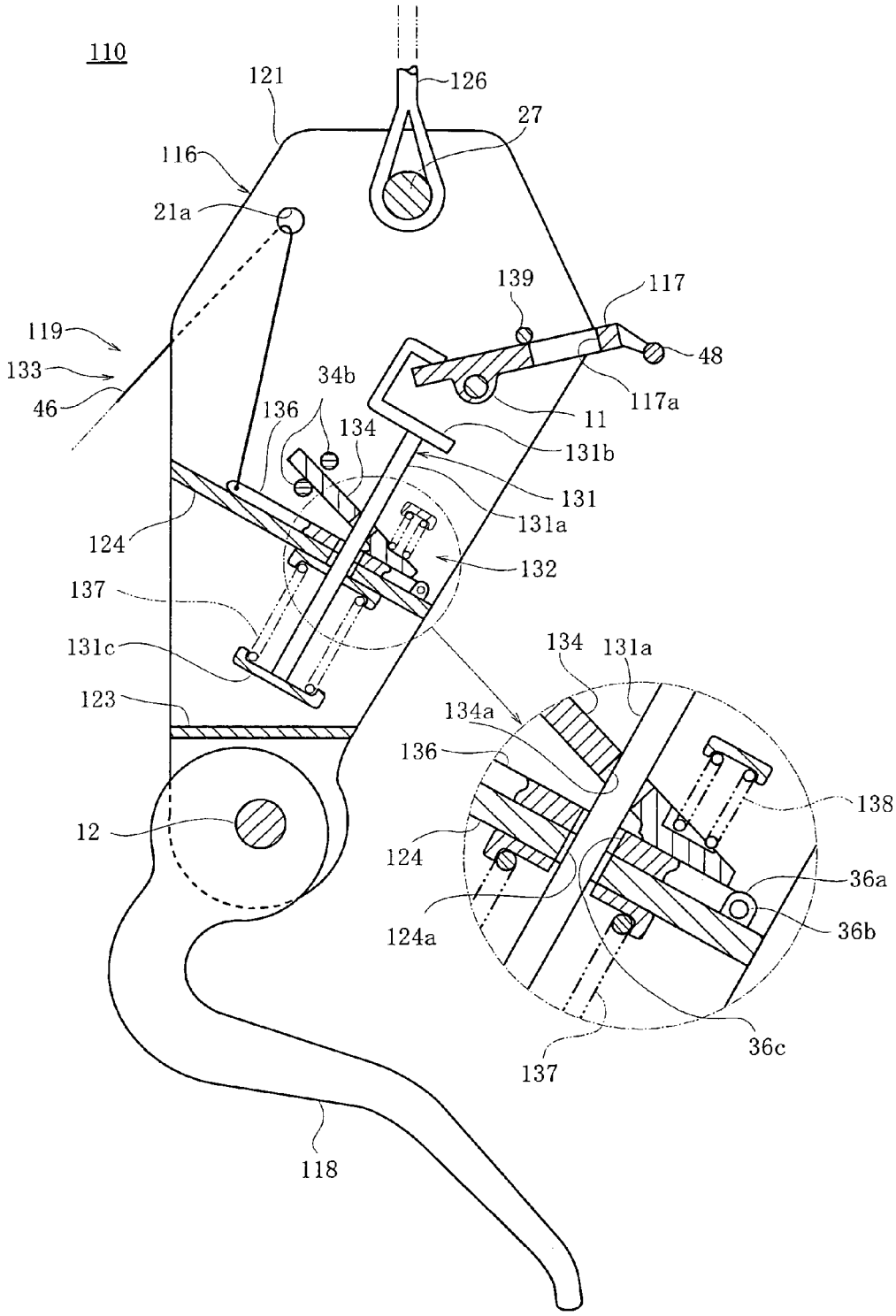
FIG. 12 is a cross-sectional view corresponding to FIG. 1 and showing a dismounting device for a heavy load hoisting sling according to a second embodiment of the present invention.
Figure 13:
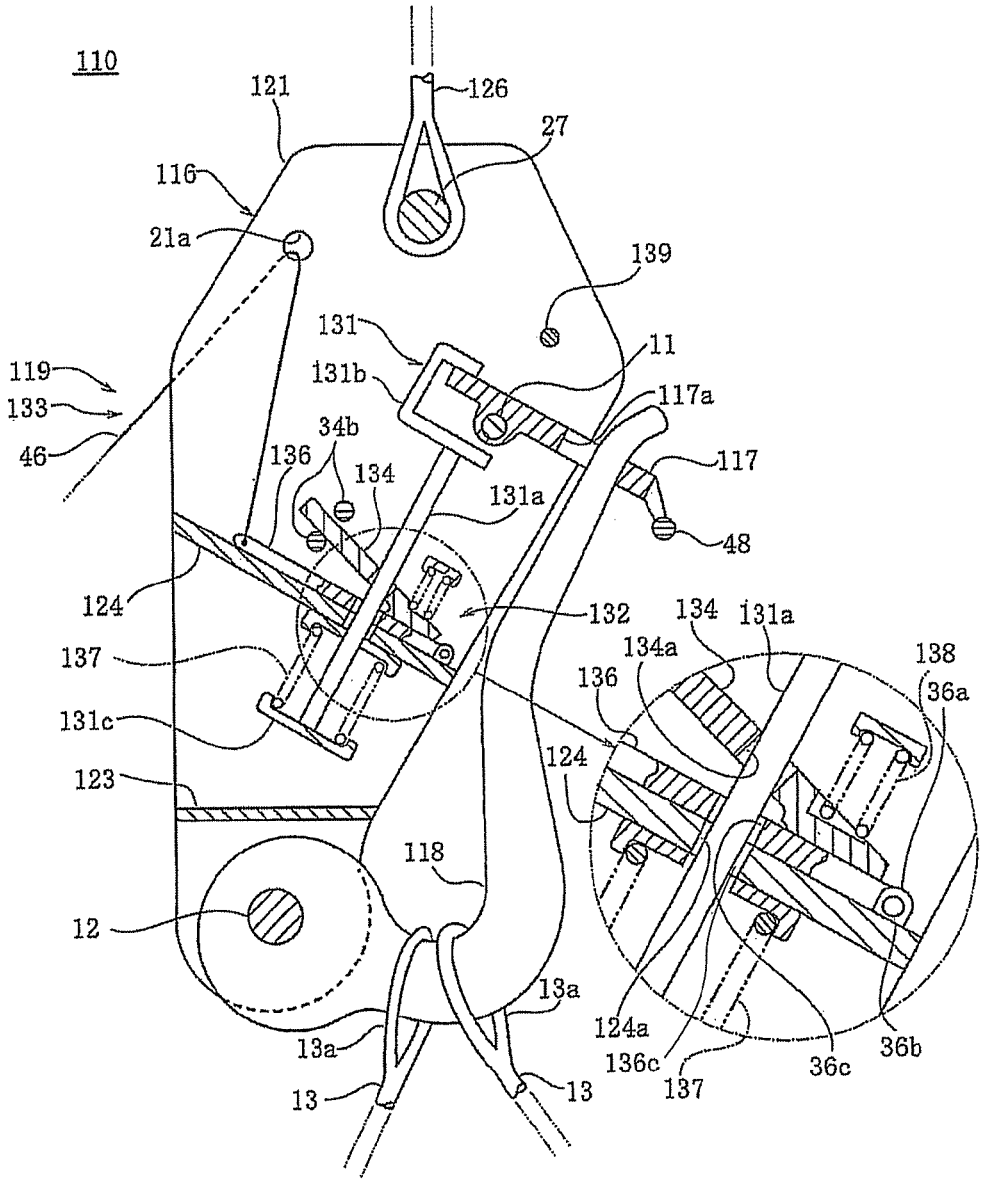
FIG. 13 is a cross-sectional view corresponding to FIG. 12 and showing a situation where rings of slings are fitted onto a link lever, and a distal end of the link lever is engaged with a distal end of a lever holder.
Figure 14:
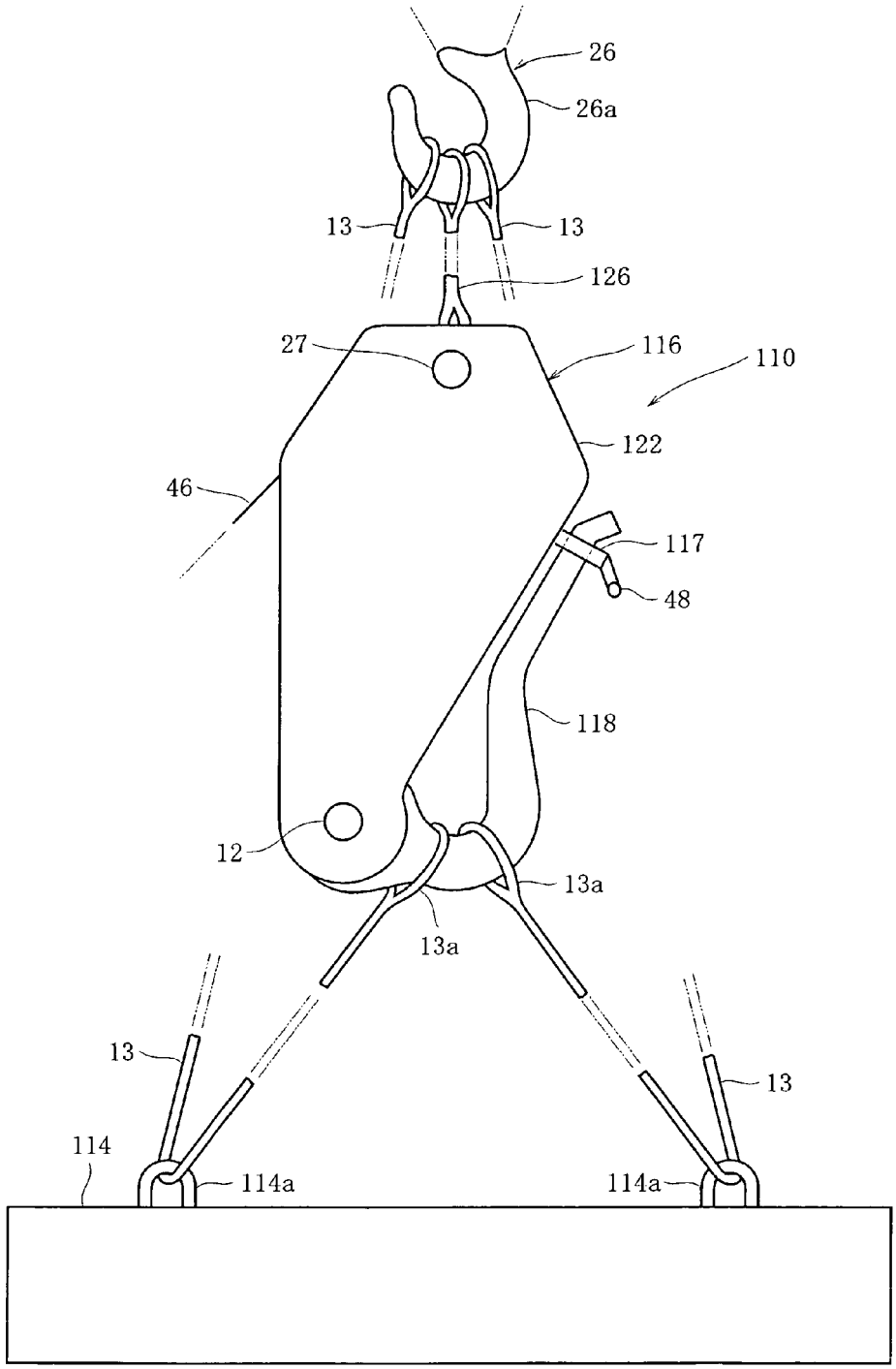
FIG. 14 is a front view of the dismounting device in a state where a concrete block is hoisted by the dismounting device.

FIG. 12 through FIG. 14 show a second embodiment of the present invention. In FIG. 12 through FIG. 14, the same reference numerals as those in the first embodiment designate the identical parts, respectively.

In this embodiment, reference numeral 110 designates a dismounting device for slings 13, which comprises: a base 116; a single lever holder 117 pivotally connected to a substantial center of a single first shaft 11 affixed to the base; a single link lever 118 having a proximal end swingably mounted on a single second shaft 12 affixed to the base 116; and releasing means 119 for releasing a distal end of the link lever from a distal end of the lever holder 117. Reference numeral 114 designates a heavy load in this embodiment, which is a concrete block having sling engagement portions 114*a* in inverted U-shapes at an upper surface of the concrete block.

The base 116 includes: a first plate 121 (FIG. 12) and a second plate 122 (FIG. 14) formed by cutting a steel plate into substantially inverted triangular shapes, respectively; a fixing plate 124 inclinedly provided at central portions of the first and second plates so as to join the first and second plates to each other at a predetermined spacing; and a lower plate 123 (FIG. 12 and FIG. 13) horizontally provided at lower portions of the first and second plates so as to join the first and second plates to each other at the predetermined spacing. Provided at a central portion of an upper end of the base 116 is a crane engagement portion 27 to be engaged by a hook 26*a* of a crane 26 through an upper sling 126 (FIG. 12 through FIG. 14), and one end of the sling is hung on the hook 26*a* of the crane 26 (FIG. 14). Further, formed at a central portion of the fixing plate 124 is a through-hole 124*a*.

The first shaft 11 is affixed to the base 116 at a rightward displaced position between the crane engagement portion 27 and the fixing plate 124 (FIG. 12 and FIG. 13). Further, the lever holder 117 is pivotally connected to the first shaft 11 such that distal end side of the lever holder is heavier than proximal end side thereof, i.e., the distal end is lowered in a loadless state. Concretely, the lever holder 117 is configured such that a portion thereof closer to its proximal end from a central portion in the longitudinal direction of the lever holder is swingably fitted on the first shaft 11, and such that the distal end of the lever holder 117 is protruded in a rightward outer direction from the first and second plates 121, 122. Further, the distal end of the lever holder 117 is formed with an elongated insertion hole 117*a* extending in a longitudinal direction of the lever holder (FIG. 12 and FIG. 13).

The second shaft 12 is affixed to a lower end of the base 116 which is narrowed leftward as it extends downwardly. The link lever 118 is formed into a substantially J-shape, and is configured such that the distal end of the link lever is engaged with the distal end of the lever holder 117 by upwardly turning the distal end of the link lever 118 to thereby insert it into the elongated insertion hole 117*a* at the distal end of the lever holder 117 (FIG. 13). Further, the link lever 118 is so configured that rings 13*a* formed at other ends of the slings 13 are allowed to be fitted on the link lever 118.

The releasing means 119 comprises a slider 131 provided on the base 116 in a vertically movable manner, locking means 132 configured to engage with the slider to temporarily lock the slider in a raised state, and unlocking means 133 for unlocking the temporarily locked slider. The slider 131 includes an ascending/descending rod 131*a* loosely inserted through the through-hole 124*a* of the fixing plate 124, an engagement plate 131*b* integrally provided at an upper portion of the ascending/descending rod, and a spring receiving member 131*c* attached to a lower end of the ascending/descending rod (FIG. 12 and FIG. 13). The engagement plate 131*b* is formed into a substantially inclined C-shape, and is configured to engage with the proximal end of the lever holder 117 to push down this proximal end, when the slider 131 is lowered (FIG. 12).

The locking means 132 comprises an adjustable bar 134 having an elongated engagement hole 134*a* through which the slider 131 is vertically movably and loosely fitted (FIG. 12 and FIG. 13). The adjustable bar 134 is formed of a flat bar, and is provided on the base 116 such that the adjustable bar 134 is swingable in a vertical plane and slidable in a longitudinal direction of the adjustable bar in a state where the adjustable bar is loosely fitted on the ascending/descending rod 131*a*. Further, the elongated engagement hole 134*a* is formed at the center of the adjustable bar 134, and has a length formed to be slightly longer than a width of the ascending/descending rod 131*a*. The adjustable bar 134 includes: one end which is to be placed on an arm 136 to be described later near a proximal end of the arm, or which is kept in a state slightly floated from the arm; and the other end movably inserted between a pair of second pins 34*b*, 34*b* affixed to the base 116 above the fixing plate 124. Identically to the first embodiment, the ascending/descending rod 131*a* is configured to be engaged with edges of the elongated engagement hole 134*a*, when the adjustable bar 134 is brought to a predetermined inclination angle.

The unlocking means 133 comprises: the arm 136 adapted to move the adjustable bar 134 in a direction to release the slider 131 from the adjustable bar 134; and an unlocking spring 137 for lowering the slider (FIG. 12 and FIG. 13). The proximal end of the arm 136 is swingably mounted on a third pin 36*b* of a first bracket 36*a* mounted on the fixing plate 124, so that the arm 136 is disposed in a state lying on the fixing plate 124 (FIG. 12 and FIG. 13). The arm 136 is formed with a through-hole 136*c* at the center of the arm, through which the ascending/descending rod 131*a* is loosely inserted.

The first plate 121 is formed with a through-hole 21*a* positioned above the distal end of the arm 136, and the distal end of the arm 136 has an operating rope 46 attached thereto. This rope 46 is passed through the through-hole 21*a* and arranged outside the base 116, and the slider 131 is released from the adjustable bar 134 by pulling this rope 46. Further, the unlocking spring 137 is loosely fitted on the ascending/descending rod 131*a*, and clamped between the fixing plate 124 and the spring receiving-member 131*c*.

Note that the lever holder 117 has a distal end surface provided with a protruded handle 48 which can be gripped by a human worker. In FIG. 12 and FIG. 13, reference numeral 138 designates a compression coil spring for urging the adjustable bar 134 to the arm 136. This spring 138 has such a function that it urges the adjustable bar 134 to the arm 136 at an urging force within a range where the adjustable bar 34 is swingable around the lower second pin 34*b* and the adjustable bar 34 is allowed to move in a longitudinal direction thereof, to thereby prevent the adjustable bar 134 from jumping such as due to vibration or impact. Further, reference numeral 139 in FIG. 12 and FIG. 13 designates a stopper pin for avoiding disengagement of the engagement plate 131*b* from proximal end of the lever holder 117.

There will be explained an operation of the sling dismounting device 110 configured in the above manner.

Firstly, the hook 26*a* of the crane 26 is engaged with the crane engagement portion 27 through the upper sling 126, and one ends of the slings 13 are hung on the hook 26*a* (FIG. 12 through FIG. 14). In this state, the base 116 is positioned just above the concrete block 114. At this time, the distal end of the link lever 118 is positioned below the proximal end thereof (FIG. 12), and the handle 48 at the distal end of the lever holder 117 is gripped and the distal end of the lever holder 117 is lowered, so that the slider 131 engaged with the proximal end of the lever holder 117 is raised. Further, since the ascending/descending rod 131*a* is engaged with edges of the elongated engagement hole 134*a* of the adjustable bar 134, the slider 131 is temporarily locked in a raised state once the slider 131 is raised. When the operator disengages his/her hand from the handle 48, upper surface of the proximal end of the lever holder 117 abuts on the engagement plate 131*b*, by virtue of balancing relationships about the first shaft 11, so that the lever holder 117 is held in an inclined state.

In this state, the slings 13 are passed through the sling engagement portion 114*a* of the concrete block 114 (FIG. 14) and engaged therewith, the rings 13*a* at the other ends of the slings are then fitted onto the link lever 118 (FIG. 13), and thereafter the link lever is turned upwardly about the second shaft 12. Next, the handle 48 is gripped and the distal end of the lever holder 117 is raised, such that the distal end of the link lever 118 is inserted into the elongated insertion hole 117*a* of the lever holder 117. This causes the distal end of the link lever 18 to be engaged with the distal end of the lever holder 17 (FIG. 13).

Thereafter, when the concrete block 114 is hoisted (FIG. 14) by the crane 26 through the hook 26*a* of the crane 26, the base 116, and the slings 13, the weight of the concrete block 114 is applied to the link lever 118, i.e., relatively larger forces by rotation moment based on the weight of the concrete block 114 outwardly act on the distal end of the link lever 118, so that the distal end of the link lever 118 is pressed against an inner end surface of the elongated insertion hole 117*a* of the lever holder 117. This increases a frictional force between the distal end of the link lever 118 and the distal end of the lever holder 117, so that the distal end of the link lever 118 is brought into a state engaged with the distal end of the lever holder 117. At this time, the center of the crane engagement portion 27 and the rings 13*a* of the slings 13 fitted on the link lever 118 are located on substantially the same vertical line (FIG. 13).

When the concrete block 114 is downed at a predetermined place, the slings 13 are relaxed to thereby remove the relatively larger force having outwardly acted on the distal end of the link lever 118. When the operating rope 46 is pulled in this state, the arm 136 is upwardly turned around the third pin 36*b* and the proximal end of the adjustable bar 134 is raised, so that the engagement of the ascending/descending rod 131*a* with the elongated engagement hole 34*a* is released, i.e., the slider 131 is released from the adjustable bar 134.

Thus, the slider 131 is lowered by its self-weight and the resilient force of the unlocking spring 137, and the engagement plate 131*b* pushes down the proximal end of the lever holder 117. As a result, the distal end of the lever holder 117 is raised, so that the distal end of the link lever 118 is removed and released from the elongated insertion hole 117*a* and the distal end of the link lever 118 is downwardly turned, thereby causing the rings 13*a* of the slings 13 to be removed and released from the link lever 118. Further, as the base 116 is lifted by the crane 26, the slings 13 are released from the sling engagement portions 114*a* of the concrete block 114 and lifted together with the base 116. In this way, the slings 13 are allowed to be automatically dismounted from the concrete block 114 downed at a predetermined place. Note that, as the operating rope 46 is released from hands, the arm 136 is downwardly turned around the third pin 36*b* and rests on the fixing plate 124, so that the ascending/descending rod 131*a* is engaged with the edges of the elongated engagement hole 134*a* of the adjustable bar 134.

Figure 15:
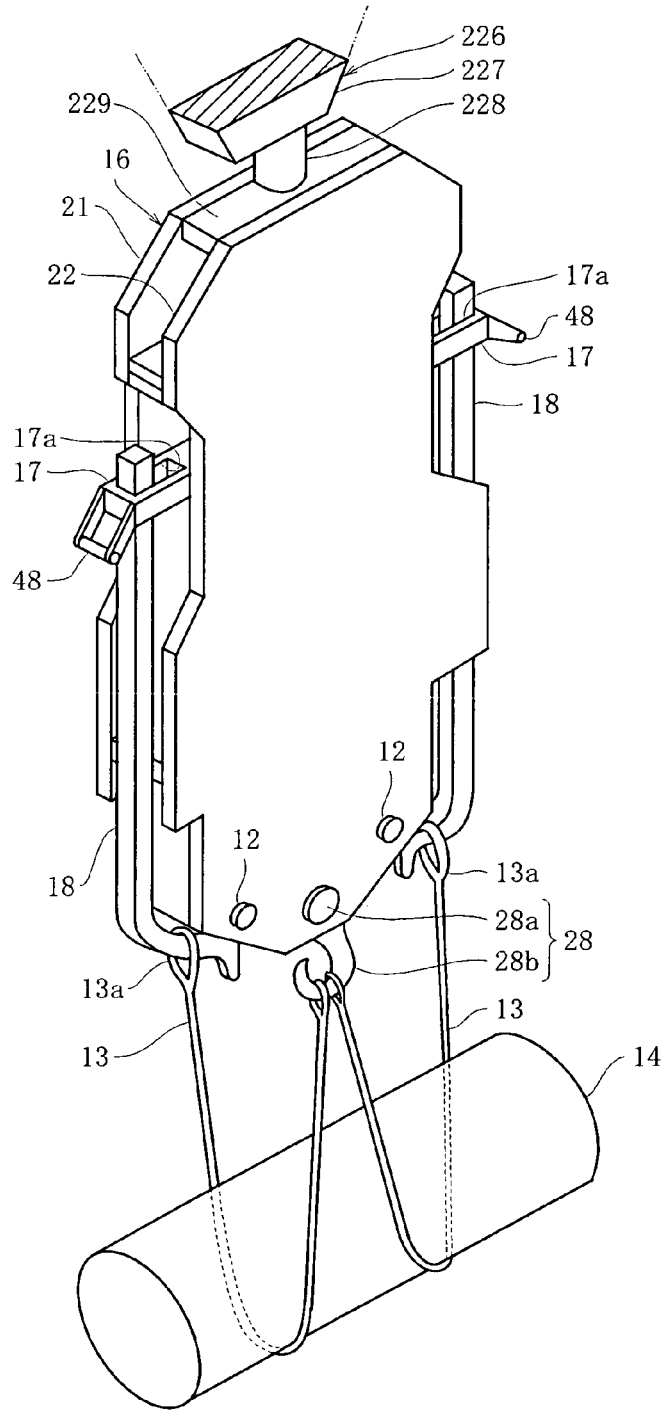
FIG. 15 is a perspective view corresponding to FIG. 11 and showing a third embodiment of the present invention.

FIG. 15 shows a third embodiment of the present invention. In FIG. 15, the same reference numerals as those in FIG. 11 designate the identical parts, respectively.

In this embodiment, the upper portion of the base 16 is incorporated into a lower portion of a hook block 227 of a crane 226. Namely, this embodiment is configured such that the upper portion of the base 16 is engaged with a lower end of a coupling member 228 suspended from the hook block 227 of the crane 226. Configurations other than the above are the same as those of the first embodiment.

In the thus configured sling dismounting device, the base 16 is normally incorporated in the lower portion of the hook block 227 of the crane 226, thereby eliminating the necessity of an operation for attaching/detaching the base 16 to/from a hook of a crane. Operations other than the above are the substantially same as those in the first embodiment, so that the repeated description is omitted.

Figure 16:
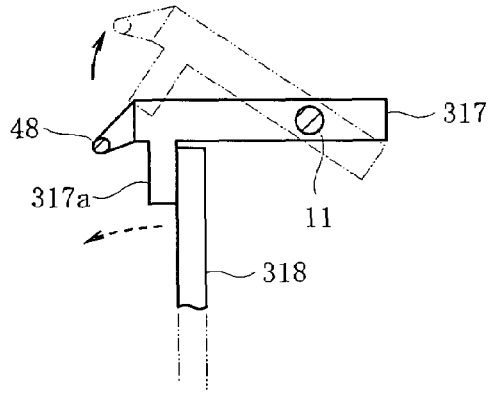
FIG. 16 is a cross-sectional view of an essential part of a fourth embodiment of the present invention and showing a state where a distal end of a link lever is engaged with a distal end of a lever holder.

FIG. 16 shows a fourth embodiment of the present invention. In FIG. 16, the same reference numerals as those in FIG. 1 designate the identical parts, respectively.

In this embodiment, provided at a distal end of a lever holder 317 is a downwardly extending engagement piece 317*a*, and a distal end of a link lever 318 is configured to be engaged with the engagement piece 317*a*. Configurations other than the above are the same as those of the first embodiment.

In the thus configured sling dismounting device, the distal end of the link lever 318 is not inserted into an elongated insertion hole of the lever holder, but simply engaged with the engagement piece 317*a* protruded from the lever holder 317, thereby enabling improvement of workability. Operations other than the above are the substantially same as those in the first embodiment, so that the repeated description is omitted.

Figure 17:
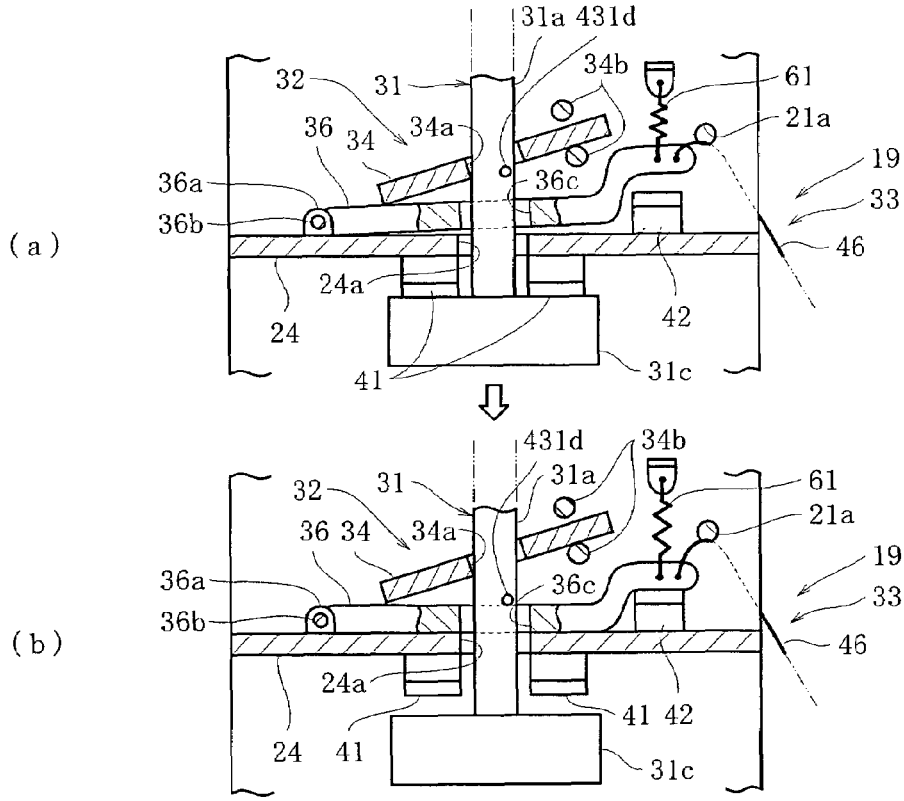
FIG. 17 is a cross-sectional view of essential parts of a fifth embodiment of the present invention, and showing a state where a slider is lowered and an engagement pin pushes down an arm so that a distal end of the arm is brought into contact with a second magnet.

FIG. 17 shows a fifth embodiment of the present invention. In FIG. 17, the same reference numerals as those in FIG. 1 designate the identical parts, respectively.

In this embodiment, the ascending/descending rod 31*a* of the slider 31 has an engagement pin 431*d* protruded from a side surface of the ascending/descending rod, instead of the linear member in the first embodiment. This engagement pin 431*d* is protruded in a manner adapted to be abutted on widthwise side edges of a through-hole 36*c* of an arm 36. Configurations other than the above are the same as those of the first embodiment.

In the thus configured sling dismounting device, when the slider 31 is lowered, the engagement pin 431*d* abuts on the widthwise side edges of the through-hole 36*c* of the arm 36 to thereby push down the distal end of the arm 36, so that the distal end of the arm is attracted and held by a magnetic force of a second magnet 42 thereby engaging an adjustable bar 34 with the slider 31 (FIG. 17(*b*). Operations other than the above are the substantially same as those in the first embodiment, so that the repeated description is omitted.

Although each lever holder has been pivotally connected to the associated first shaft such that the distal end side of the lever holder is made heavier than the proximal end side in the first through fifth embodiments, the lever holder may be pivotally connected to the associated first shaft such that the distal end side of the lever holder is made lighter than the proximal end side, or the lever holder may be pivotally connected to the associated first shaft such that the distal end side of the lever holder is balanced with the proximal end side, when the proximal end of the lever holder is slidably and swingably mounted on the end of the engagement plate.

Examples of structures for slidably and swingably mount the proximal end of each lever holder to the end of the engagement plate, include a structure having: an elongated hole formed in and longitudinally extending along the proximal end of the lever holder or the end portion of the engagement plate; and a pin protruded at the end portion of the engagement plate or the proximal end of the lever holder, so as to engage with the elongated hole.

According to the present invention as described above, each lever holder is swingably mounted on the base through the associated first shaft, the proximal end of each link lever having the distal end engageable with the distal end of the associated lever holder, is swingably mounted on the base through the associated second shaft, the releasing means is configured to lower the proximal end of each lever holder, the releasing means includes the slider, which is vertically movably provided on the base, and which engages with the proximal end of each lever holder to thereby urge the same in the direction to push down the proximal end of the lever holder, the slider includes the ascending/descending rod, and the engagement plate which is provided integrally with the ascending/descending rod at the upper portion of the ascending/descending rod and which extends horizontally or is inclined, and the engagement plate is configured to engage with the proximal end of each lever holder. Thus, there is kept a state where the distal end of each link lever is engaged with the distal end of the associated lever holder when a weight of a heavy load is applied to the link lever, while the distal end of each lever holder is raised by the releasing means when no weight is applied to each link lever so that the distal end of the link lever is released from the distal end of the associated lever holder. As a result, the heavy load can be assuredly held once the heavy load is hoisted. Further, when the slider of the releasing means is lowered and the engagement plate is engaged with the proximal end of each lever holder to thereby allow the self-weight of the slider to act in a state where the heavy load is previously hoisted, the other end of each sling is released from the associated link lever so that the sling can be rapidly dismounted from the heavy load when the heavy load is downed at a predetermined place. Moreover, as compared with conventional dismounting devices which have been large-sized than required correspondingly to sizes of rings of bottom wires in case of hoisting a heavier load, it is enough for the dismounting device according to the present invention to be large-sized at a required minimum extent to ensure a strength corresponding to a weight of a heavier load even in case of hoisting the heavier load.

Further, if the angle cx is an obtuse angle when a weight of a heavy load is extremely larger than the self-weight of the link lever(s), the beam portion of the link lever is turned in a direction to further transfer from a horizontal posture to a downward posture, so that other ends of slings are released from the link lever. In turn, if the angle β is an obtuse angle when a weight of a heavy load is relatively small so that the self-weight of the link lever(s) affects a rotation moment thereof, the beam portion of the link lever is turned in a direction to further transfer from a horizontal posture to a downward posture, so that other ends of slings are released from the link lever.

The slider of the releasing means is vertically movably provided on the base, the locking means for temporarily locking the slider in a raised state is provided on the base, and the unlocking means is configured to unlock the temporarily locked slider. This maintains a state where the distal end of each link lever is engaged with the distal end of the associated lever holder, when a weight of a heavy load is applied to the link lever through the slings. Further, when the temporarily locked slider is unlocked by the unlocking means and the weight of the heavy load is not applied to each link lever through the slings, the distal end of the lever holder is raised by the slider so that the distal end of each link lever is released from the distal end of the lever holder. As a result, in hoisting a heavy load, the heavy load can be assuredly held, and slings can be automatically dismounted from a heavy load when the heavy load is downed at a predetermined place, by unlocking the temporarily locked slider by the unlocking means in a state where the heavy load is previously hoisted Further, when the ascending/descending rod of the slider is configured to be movably inserted to the through hole of the fixing plate of the base and the engaging plate provided on the upper part of the ascending/descending rod is configured to be engageable with the proximal end of the lever holder, there is maintained a state where the distal end of each link lever is engaged with the distal end of the associated lever holder when the weight of the heavy load is applied to the link lever through the slings, and the engagement plate raises the distal end of each lever holder by self-weights of the ascending/descending rod and engagement plate itself to thereby release the distal end of each link lever from the distal end of the associated lever holder when the weight of the heavy load is not applied to each link lever through the slings. This allows a heavy load to be assuredly held when the same is hoisted. Further, slings can be automatically dismounted from a heavy load when the heavy load is downed at a predetermined place, by unlocking the temporarily locked slider by the unlocking means to thereby cause the self-weight of the engagement plate to act on the proximal end of each lever holder in a state where the heavy load is previously hoisted.

INDUSTRIAL APPLICABILITY

The dismounting device for a heavy load hoisting sling of the present invention can be used to dismount a sling from a heavy load when the heavy load engaged with and hoisted by the sling is downed at a predetermined place.

The invention claimed is:

1. A dismounting device for a heavy load hoisting sling, comprising:

a base including at its upper end a crane engagement portion to be engaged with a hook of a crane or with a hook block;

a lever holder pivotally connected at a substantial center thereof to a first shaft affixed to the base below the crane engagement portions;

a link lever including a proximal end swingably mounted on a second shaft affixed to the base below the first shaft, and a distal end to be releasably engaged with a distal end of the lever holder, in which one end of a sling including the other end to be hung on the hook of the crane or on the base so as to be engageable with a heavy load, is releasably hung on the link lever; and releasing means for lowering a proximal end of the lever holder to raise the distal end of the lever holder, thereby releasing the distal end of the link lever from the distal end of the lever holder and further comprising a handle that protrudes from the distal end of said lever holder which can be gripped by a human worker, wherein said releasing means comprises:

a slider vertically movably provided on said base to engage with the proximal end of said lever holder, thereby urging the proximal end of said lever holder in a direction to push down the same;

locking means provided on said base and engaged with said slider to thereby temporarily lock said slider in a raised state; and unlocking means for unlocking the temporarily locked slider;

wherein when the weight of the heavy load is applied to the link lever through said sling, there is maintained a state where the distal end of said link lever is engaged with the distal end of said lever holder; and wherein said slider is configured to raise the distal end of said lever holder to thereby release the distal end of said link lever from the distal end of said lever holder when the temporarily locked slider is unlocked by said unlocking means and the weight of the heavy load is not applied to said link lever through said sling.

2. The dismounting device for a heavy load hoisting sling of claim 1, wherein said locking means comprises an adjustable bar having an elongated engagement hole through which said slider is vertically movably fitted, said adjustable bar being provided on said base in a manner to be swingable in a vertical plane and slidable in a longitudinal direction of said adjustable bar in the fitted state; wherein said slider is configured to be engaged with edges of said elongated engagement hole when said adjustable bar is brought to a predetermined inclination angle; and wherein said unlocking means comprises an arm adapted to move said adjustable bar in a direction to release said slider from said adjustable bar.

3. The dismounting device for a heavy load hoisting sling of claim 2, further comprising: a second magnet configured to retain said arm by a magnetic force in a state where said adjustable bar is engaged with said slider; a resilient body configured to urge said arm in a direction to release said slider from said adjustable bar; second switchover means for generating or erasing the magnetic force of said second magnet; and remote control means for remotely controlling said second switchover means to thereby control said second magnet.

4. The dismounting device for a heavy load hoisting sling of claim 1, wherein said locking means comprises a first magnet adapted to retain said slider in a raised state by a magnetic force and to release said slider by erasing the magnetic force; and wherein said unlocking means comprises: first switchover means for generating or erasing the magnetic force of said first magnet; and remote control means for remotely controlling said first switchover means to thereby control said first magnet.

5. A dismounting device for a heavy load hoisting sling, comprising:

a base including at its upper end a crane engagement portion to be engaged with a hook of a crane or with a hook block;

a lever holder pivotally connected at a substantial center thereof to a first shaft affixed to the base below the crane engagement portions;

a link lever including a proximal end swingably mounted on a second shaft affixed to the base below the first shaft, and a distal end to be releasably engaged with a distal end of the lever holder, in which one end of a sling including the other end to be hung on the hook of the crane or on the base so as to be engageable with a heavy load, is releasably hung on the link lever; and releasing means for lowering a proximal end of the lever holder to raise the distal end of the lever holder, thereby releasing the distal end of the link lever from the distal end of the lever holder and further comprising a handle that protrudes from the distal end of said lever holder which can be gripped by a human worker, wherein said releasing means comprises:

a slider vertically movably provided on said base to engage with the proximal end of said lever holder, thereby urging the proximal end of said lever holder in a direction to push down the same;

locking means provided on said base and engaged with said slider to thereby temporarily lock said slider in a raised state;

unlocking means for unlocking the temporarily locked slider;

wherein when the weight of the heavy load is applied to the link lever through said sling, there is maintained a state where the distal end of said link lever is engaged with the distal end of said lever holder; and wherein said slider is configured to raise the distal end of said lever holder to thereby release the distal end of said link lever from the distal end of said lever holder when the temporarily locked slider is unlocked by said unlocking means and the weight of the heavy load is not applied to said link lever through said sling;

wherein said base includes: a first plate and a second plate both extending vertically; and a fixing plate provided between said first plate and said second plate, to horizontally extend or to be inclined, to thereby couple said first plate to said second plate, said fixing plate being formed with a through-hole;

wherein said slider includes an ascending/descending rod loosely inserted through said through-hole, and an engagement plate which is integrally provided at an upper portion of said ascending/descending rod and which extends horizontally or is inclined;

wherein said engagement plate is configured to engage with the proximal end of said lever holder;

wherein when the weight of the heavy load is applied to said link lever through said sling, there is maintained a state where the distal end of said link lever is engaged with the distal end of said lever holder; and wherein said engagement plate is configured to raise the distal end of said lever holder by its own weight of at least said ascending/descending rod and said engagement plate itself to thereby release the distal end of said link lever from the distal end of said lever holder when the weight of the heavy load is not applied to said link lever through said sling.

6. A dismounting device for a heavy load hoisting sling, comprising:

a base including at its upper end a crane engagement portion to be engaged with a hook of a crane or with a hook block;

a lever holder pivotally connected at a substantial center thereof to a first shaft affixed to the base below the crane engagement portion;

a link lever including a proximal end swingably mounted on a second shaft affixed to the base below the first shaft, and a distal end to be releasably engaged with a distal end of the lever holder, in which one end of a sling including the other end to be hung on the hook of the crane or on the base so as to be engageable with a heavy load, is releasably hung on the link lever and releasing means (19, 119) for lowering a proximal end of the lever holder (17, 117) to raise the distal end of the lever holder (17, 117), thereby releasing the distal end of the link lever (18, 118) from the distal end of the lever holder (17, 117); characterized in that said releasing means (19, 119) comprises a slider (31, 131) vertically movably provided on said base (16, 116) to engage with the proximal end of said lever holder (17 117), thereby urging the proximal end of said lever holder (17, 117) in a direction to push down the same;

that said slider (31, 131) includes an ascending/descending rod (31*a*, 131*a*) and an engagement plate (31*b*, 131*b*) which is integrally provided at an upper portion of said ascending/descending rod (31*a*, 131*a*) and which extends horizontally or is inclined; and that said engagement plate is configured to engage with the proximal end of said lever holder (17, 117).

7. The dismounting device for a heavy load hoisting sling of claim 6, wherein said link lever (18) includes: a proximal end portion (18*a*) swingably mounted on said second shaft (12); a curved portion (18*b*) provided continuously to said proximal end portion (18*a*) and curved at a predetermined curvature radius; a distal end portion (18*c*) engageable with the distal end of said lever holder (17); and a beam portion (18*d*) connecting said curved portion (18*b*) and said distal end portion (18*c*) with each other; and wherein, when assuming:

a limit point of action (P) which is a position where the other end of said sling (13) contacts with said link lever (18), when said link lever (18) is turned about said second shaft (12) so that said beam portion (18*d*) is brought from an upright posture to a horizontal posture, by releasing said link lever (18) from said lever holder (17), from a state where the one end of said sling (13) engaged with said heavy load (14) is hung on said link lever (18) and the distal end of said link lever (18) is engaged with the distal end of said lever holder (17);

an angle a which is defined between: a straight line (L) connecting a central point of said second shaft (12) to said limit point of action (P); and an inside line of said beam portion (18*d*); and an angle β which is defined between: a straight line (M) connecting the central point of said second shaft (12) to a center of gravity (G) of said link lever (18); and an inside line of said beam portion (18*d*);

one or each of said angle (α) and angle (β) is configured to be an obtuse angle.

8. The dismounting device for a heavy load hoisting sling of claim 6, wherein said releasing means (19, 119) includes, in addition to said slider (31, 131);

locking means (32, 132) provided on said base (16, 116) and engaged with said slider (31, 131) to thereby temporarily lock said slider (31, 131) in a raised state; and unlocking means (33, 133) for unlocking the temporarily locked slider (31, 131);

wherein when the weight of the heavy load (14) is applied to the link lever (18, 118) through said sling (13), there is maintained a state where the distal end of said link lever (18, 118) is engaged with the distal end of said lever holder (17, 117); and wherein said slider (31, 131) is configured to raise the distal end of said lever holder (17, 117) to thereby release the distal end of said link lever (18, 118) from the distal end of said lever holder (17, 117) when the temporarily locked slider (31, 131) is unlocked by said unlocking means (33, 133) and the weight of the heavy load (14) is not applied to said link lever (18; 118) through said sling (13).

9. The dismounting device for a heavy load hoisting sling of claim 8, wherein said base (16, 116) includes: a first plate (21, 121) and a second plate (22, 122) both extending vertically; and a fixing plate (24, 124) provided between said first plate (21, 121) and said second plate (22, 122), to horizontally extend or to be inclined, to thereby couple said first plate (21, 121) to said second plate (22, 122), said fixing plate (24, 124) being formed with a through-hole (24*a*, 124*a*);

wherein said ascending/descending rod (31*a*, 131*a*) of the slider (31, 131) loosely inserted through said through-hole(24*a*, 124*a*);

wherein when the weight of the heavy load (14, 114) is applied to said link lever (18, 118) through said sling (13), there is maintained a state where the distal end of said link lever (18, 118) is engaged with the distal end of said lever holder (17, 117); and wherein said engagement plate (31*b*, 131*b*) is configured to raise the distal end of said lever holder (17, 117) by its own weight of at least said ascending/descending rod (31*a*, 131*a*) and said engagement plate itself to thereby release the distal end of said link lever (18, 118) from the distal end of said lever holder (17, 117) when the weight of the heavy load (14, 114) is not applied to said link lever (18, 118) through said sling (13).

10. The dismounting device for a heavy load hoisting sling of claim 8, wherein said locking means (32, 132) comprises an adjustable bar (34, 134) having an elongated engagement hole (34*a*, 134*a*) through which said slider (31, 131) is vertically movably fitted, said adjustable bar (34, 134) being provided on said base (16, 116) in a manner to be swingable in a vertical plane and slidable in a longitudinal direction of said adjustable bar (34, 134) in the fitted state;

wherein said slider (31, 131) is configured to be engaged with edges of said elongated engagement hole (34*a*, 134*a*) when said adjustable bar (34, 134) is brought to a predetermined inclination angle; and wherein said unlocking means (33, 133) comprises an arm (36, 136) adapted to move said adjustable bar (34, 134) in a direction to release said slider (31, 131) from said adjustable bar (34, 134).

11. The dismounting device for a heavy load hoisting sling of claim 10, further comprising: a second magnet (42) configured to retain said arm (36) by a magnetic force in a state where said adjustable bar (34) is engaged with said slider (31); a resilient body (61) configured to urge said arm (36) in a direction to release said slider (31) from said adjustable bar (34); second switchover means (52) for generating or erasing the magnetic force of said second magnet (42); and remote control means (37) for remotely controlling said second switchover means (52) to thereby control said second magnet (42).

12. The dismounting device for a heavy load hoisting sling of claim 8, wherein said locking means (32) comprises a first magnet (41) adapted to retain said slider (31) in a raised state by a magnetic force and to release said slider (31) by erasing the magnetic force; and wherein said unlocking means (33) comprises: first switchover means (51) for generating or erasing the magnetic force of said first magnet (41); and remote control means (37) for remotely controlling said first switchover means (51) to thereby control said first magnet (41).

13. The dismounting device for a heavy load hoisting sling of claim 6, further comprising a handle (48) which is protruded from the distal end of said lever holder (17, 117) and which can be gripped by a human worker.

14. A dismounting device for a heavy load hoisting sling, comprising:

a base including at its upper end a crane engagement portion to be engaged with a hook of a crane or with a hook block;

a lever holder pivotally connected at a substantial center thereof to a first shaft affixed to the base below the crane engagement portions;

a link lever including a proximal end swingably mounted on a second shaft affixed to the base below the first shaft, and a distal end to be releasably engaged with a distal end of the lever holder, in which one end of a sling including the other end to be hung on the hook of the crane or on the base so as to be engageable with a heavy load, is releasably hung on the link lever; and releasing means for lowering a proximal end of the lever holder to raise the distal end of the lever holder, thereby releasing the distal end of the link lever from the distal end of the lever holder and further comprising a handle that protrudes from the distal end of said lever holder (17, 117) which can be gripped by a human worker a slider vertically movably provided on said base to engage with the proximal end of said lever holder, thereby urging the proximal end of said lever holder in a direction to push down the same;

locking means provided on said base and engaged with said slider to thereby temporarily lock said slider in a raised state; and unlocking means for unlocking the temporarily locked slider;

wherein when the weight of the heavy load is applied to the link lever through said sling, there is maintained a state where the distal end of said link lever is engaged with the distal end of said lever holder; and wherein said slider is configured to raise the distal end of said lever holder to thereby release the distal end of said link lever from the distal end of said lever holder when the temporarily locked slider is unlocked by said unlocking means and the weight of the heavy load is not applied to said link lever through said sling and wherein said base includes: a first plate and a second plate both extending vertically; and a fixing plate provided between said first plate and said second plate, to horizontally extend or to be inclined, to thereby couple said first plate to said second plate, said fixing plate being formed with a through-hole;

wherein said slider includes an ascending/descending rod loosely inserted through said through-hole, and an engagement plate which is integrally provided at an upper portion of said ascending/descending rod and which extends horizontally or is inclined;

wherein said engagement plate is configured to engage with the proximal end of said lever holder;

wherein when the weight of the heavy load is applied to said link lever through said sling, there is maintained a state where the distal end of said link lever is engaged with the distal end of said lever holder; and wherein said engagement plate is configured to raise the distal end of said lever holder by its own weight of at least said ascending/descending rod and said engagement plate itself to thereby release the distal end of said link lever from the distal end of said lever holder when the weight of the heavy load is not applied to said link lever through said sling wherein said locking means comprises an adjustable bar having an elongated engagement hole through which said slider is vertically movably fitted, said adjustable bar being provided on said base in a manner to be swingable in a vertical plane and slidable in a longitudinal direction of said adjustable bar in the fitted state; wherein said slider is configured to be engaged with edges of said elongated encirclement hole when said adjustable bar is brought to a predetermined inclination angle; and wherein said unlocking means comprises an arm adapted to move said adjustable bar in a direction to release said slider from said adjustable bar.

15. The dismounting device for a heavy load hoisting sling of claim 14, wherein said locking means comprises a first magnet adapted to retain said slider in a raised state by a magnetic force and to release said slider by erasing the magnetic force; and wherein said unlocking means comprises: first switchover means for generating or erasing the magnetic force of said first magnet; and remote control means for remotely controlling said first switchover means to thereby control said first magnet.

16. The dismounting device for a heavy load hoisting sling of claim 14, further comprising: a second magnet configured to retain said arm by a magnetic force in a state where said adjustable bar is engaged with said slider; a resilient body configured to urge said arm in a direction to release said slider from said adjustable bar; second switchover means for generating or erasing the magnetic force of said second magnet; and remote control means for remotely controlling said second switchover means to thereby control said second magnet.

* * * * *